US008455172B2

(12) United States Patent
Awamura et al.

(10) Patent No.: US 8,455,172 B2
(45) Date of Patent: Jun. 4, 2013

(54) TONER, METHOD FOR PRODUCING THE SAME, AND DEVELOPER

(75) Inventors: Junichi Awamura, Shizuoka (JP); Hiroshi Yamashita, Shizuoka (JP); Teruki Kusahara, Shizuoka (JP); Tsuyoshi Sugimoto, Shizuoka (JP); Tomomi Suzuki, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 304 days.

(21) Appl. No.: 12/891,221

(22) Filed: Sep. 27, 2010

(65) Prior Publication Data

US 2011/0076612 A1 Mar. 31, 2011

(30) Foreign Application Priority Data

Sep. 30, 2009 (JP) ..... 2009-226306

(51) Int. Cl.
*G03G 5/00* (2006.01)

(52) U.S. Cl.
USPC ..... 430/137.18; 430/137.19

(58) Field of Classification Search
USPC ..... 430/137.18, 137.19
See application file for complete search history.

(56) References Cited

U.S. PATENT DOCUMENTS

| | | | | |
|---|---|---|---|---|
| 2008/0292985 | A1 | 11/2008 | Suzuki et al. | |
| 2009/0130589 | A1 * | 5/2009 | Udo et al. | 430/137.11 |
| 2009/0214973 | A1 | 8/2009 | Sugimoto et al. | |
| 2009/0269692 | A1 | 10/2009 | Awamura et al. | |
| 2009/0280421 | A1 | 11/2009 | Awamura et al. | |
| 2010/0035170 | A1 | 2/2010 | Sugimoto et al. | |

FOREIGN PATENT DOCUMENTS

| | | |
|---|---|---|
| JP | 8-176310 | 7/1996 |
| JP | 2624639 | 4/1997 |
| JP | 2005-15589 | 1/2005 |

* cited by examiner

*Primary Examiner* — Mark A Chapman
(74) *Attorney, Agent, or Firm* — Oblon, Spivak, McClelland, Maier & Neustadt, L.L.P.

(57) ABSTRACT

A method for producing a toner, containing: dispersing, in an aqueous medium, an oil phase which contains an organic solvent, and a binder resin component contained in the organic solvent, where the binder resin component contains a crystalline polyester resin and an amorphous polyester resin; and removing the organic solvent from the dispersion to obtain the toner, in which the dispersing further contains heating and dissolving the crystalline polyester and the amorphous polyester in the organic solvent to obtain a solution, cooling the solution so as to recrystallize the crystalline polyester resin, and mechanically pulverizing the recrystallized crystalline polyester resin so as to obtain a crystalline polyester dispersion.

12 Claims, 2 Drawing Sheets

TONER, METHOD FOR PRODUCING THE SAME, AND DEVELOPER

BACKGROUND OF THE INVENTION

1. Field of the Invention

The present invention relates to a toner and a method for producing the same, as well as a developer.

2. Description of the Related Art

In recent years, there appears a market for toners in which particle diameters thereof are downsized for producing high quality output images and the low-temperature fixing ability thereof is improved for saving energy consumed in the image forming process using the same.

Toners obtained by a conventional kneading and pulverization process are difficult to downsize, have indeterminate particle shapes and statistically dispersed particle diameter distributions, require large amounts of energy for fixation, and have other various problems. In particular, toners manufactured by the kneading and pulverization process have the following problem in fixation: toner particles manufactured by the kneading and pulverization process each frequently have in itself interfacing spaces which are filled with a releasing agent (wax) and at which each of the toner particles is cracked by pulverization, thus large surface areas of each of the toner particles produced by cracking are covered with the wax, which, while producing releasing effect, facilitates toner adhesion to carriers, photoconductors, and blades, leading to unsatisfactory performance thereof as a whole.

In order to solve the above-mentioned problems of the toners produced by the kneading and pulverization process, a toner production method using a polymerization process has been proposed.

When such a polymerization process is used, the toner particles being produced can be easily downsized and may have a particle size distribution with a size of statistical dispersion smaller than a size of statistical dispersion of a particle size distribution of toners produced by the pulverization process, and, further, a wax can be encapsulated in each of the toner particles.

For a production method for toner that employs such a polymerization process, a production method has been proposed by which a toner which contains, as a toner binder, products of an extension reaction of a urethane-modified polyester and which has a working sphericity of 0.90 to 1.00 for improving flowability, low-temperature fixing ability, and anti-hot offset property of the toner can be produced (e.g. Japanese Patent Application Laid-Open (JP-A) No. 11-133665).

In addition, a production method has been proposed by which a toner which is excellent in flowability as the toner powder and in transfer efficiency when the toner particles are downsized, and as well as excellent in every property of heat resistant storage stability, low-temperature fixing ability, and anti-hot offset property can be produced (e.g., JP-A Nos. 2002-287400 and 2002-351143).

Furthermore, a production method for a toner including maturing the toner for stabilizing the molecular weight distribution of a toner binder produced and for achieving both low-temperature fixing ability and anti-hot offset property in a balanced manner has been proposed (e.g., Japanese Patent (JP-B) No. 2579150 and JP-A No. 2001-158819).

Further, a production method is disclosed in which a crystalline polyester is introduced into a toner using the polymerization process for improving low-temperature fixing ability. In JP-A No. 08-176310, a method for preparing a dispersion using a solvent for phase separation is proposed as a method for preparing a dispersion of crystalline polyester. However, only a coarse dispersion having a dispersion particle diameter of several tens micrometers to several hundreds micrometers can be produced by the use of the proposed method for preparing a dispersion, and a dispersion that has a volume average particle diameter of 1.0 μm or less and that thus can be used in a toner, cannot be produced by the proposed method for preparing a dispersion. Further, in JP-A No. 2005-15589, an attempt to downsize the particle diameter of a dispersion of crystalline polyester is described in which only a crystalline polyester is mixed in a solvent and the resultant mixture is heated and cooled. However, the results of the attempt were unstable and insufficient.

A production method for a toner proposed in JP-A Nos. 11-133665, 2002-287400, and 2002-351143 is the method including addition polymerizing a polyester prepolymer having an isocyanate group with an amine in a reaction system composed of a mixture of an organic solvent and an aqueous medium for increasing the molecular weight of the polyester polymer.

Methods such as those mentioned above and toners obtained by the methods, however, have been insufficient for use, because, though they improve anti-hot offset property, they invite degradation of the low-temperature fixing ability and of the glossiness of images after fixation.

Similarly, although they can easily be applied to a polycondensation reaction which is a high-temperature reaction, production methods for a toner proposed in JP-B No. 2579150 and JP-A No. 2001-158819 cannot be applied to such reaction systems as mentioned above in which an organic solvent and an aqueous medium coexist, before various conditions are earnestly tested and satisfied for successfully achieving the application.

Also, in JP-A No. 08-176310 and JP-A No. 2005-15589, a crystalline polyester is introduced into a toner which is produced using a polymerization process for improving the low-temperature fixing ability, however, a dispersion having downsized particle diameters cannot be stably obtained, which results in degradation of the particle size distribution of the toner, making the procedure inadequate for achieving the production of a desired toner.

BRIEF SUMMARY OF THE INVENTION

In view of the above-mentioned problems of the related art, the present invention is aimed at providing a toner having stable low-temperature fixing ability and stable anti-hot offset property and a method for producing the same, as well as a developer containing the same.

The present invention is based on the above findings obtained by the present inventors, and means for solving the above problems are as follows:

<1> A method for producing a toner, containing:

dispersing, in an aqueous medium, an oil phase which contains an organic solvent, and a binder resin component contained in the organic solvent, where the binder resin component contains a crystalline polyester resin and an amorphous polyester resin; and removing the organic solvent from the dispersion to obtain the toner, wherein the dispersing further contains heating and dissolving the crystalline polyester and the amorphous polyester in the organic solvent to obtain a solution, cooling the solution so as to recrystallize the crystalline polyester resin, and mechanically pulverizing the recrystallized crystalline polyester resin so as to obtain a crystalline polyester dispersion.

<2> The method for producing a toner according to <1>, wherein the crystalline polyester resin contained in the dispersion of the crystalline polyester has a volume average particle diameter of 0.1 μm to 1.0 μm.

<3> The method for producing a toner according to <1>, wherein the crystalline polyester resin has an endothermic peak temperature of 50° C. to 130° C. in a DSC curve thereof.

<4> The method for producing a toner according to <1>, wherein the crystalline polyester resin has an endothermic peak temperature of 85° C. to 130° C. in a DSC curve thereof.

<5> The method for producing a toner according to any one of <1> to <4>, wherein the binder resin component of the oil phase further contains a precursor of a binder resin.

<6> The method for producing a toner according to any one of <1> to <5>, wherein the dispersing is: dissolving or dispersing at least a colorant, a releasing agent, the crystalline polyester dispersion, a precursor of a binder resin containing a modified polyester resin, and the binder resin component other than foregoing in the organic solvent to obtain the oil phase; dissolving a compound capable of extending or crosslinking the precursor in the oil phase; dispersing the oil phase in the aqueous medium in which a fine particle dispersing agent is present so as to obtain an emulsified dispersion; allowing the precursor to carry out a crosslinking reaction, or an extension reaction, or both thereof in the emulsified dispersion, and wherein the removing is removing the organic solvent from the emulsified dispersion.

<7> The method for producing a toner according to according to any one of <1> to <6>, wherein a fraction of the crystalline polyester resin soluble in o-dichlorobenzene shows a molecular weight distribution, as quantified by GPC, having a weight average molecular weight (Mw) of 1,000 to 30,000, a number average molecular weight (Mn) of 500 to 6,000, and a ratio Mw/Mn of 2 to 10.

<8> The method for producing a toner according to any one of <1> to <7>, wherein the crystalline polyester resin has a structure represented by the following general formula (1):

$$[\text{—O—CO—}(\text{CR}^1\text{=CR}^2)_1\text{—CO—O—}(\text{CH}_2)_n\text{—}]_m \qquad \text{General Formula (1)}$$

where n and m each represent the number of respective repeating units, 1 represents an integer from 1 to 3, $R^1$ and $R^2$ each represent a hydrogen atom or a hydrocarbon group and may be identical to or different from each other.

<9> The method for producing a toner according to any one of <1> to <8>, wherein the crystalline polyester resin contains an alcohol component and an acid component, where the alcohol component contains a C2-C6 diol compound, and the acid component contains at least one selected from the group consisting of fumaric acid and a derivative thereof.

<10> The method for producing a toner according to any one of <1> to <9>, wherein the crystalline polyester resin contains an alcohol component, where the alcohol component contains at least one selected from the group consisting of 1,4-butanediol, 1,6-hexanediol, and a derivative thereof.

<11> The method for producing a toner according to any one of <1> to <10>, wherein all the resin contained as the binder resin component are polyester resins.

<12> The method for producing a toner according to any one of <1> to <11>, wherein a fraction of the amorphous polyester resin soluble in tetrahydrofuran has a weight average molecular weight of $1\times10^3$ to $1\times10^4$.

<13> The method for producing a toner according to any one of <1> to <12>, wherein the amorphous polyester resin has an acid value of 1 KOHmg/g to 50 KOHmg/g.

<14> The method for producing a toner according to any one of <1> to <13>, wherein the amorphous polyester resin has a glass transition temperature of 35° C. to 70° C.

<15> The method for producing a toner according to any one of <5> to <14>, wherein the precursor of a binder resin has a weight average molecular weight of $1\times10^4$ to $3\times10^5$.

<16> A toner obtained by the method as defined in any one of <1> to <15>.

<17> The toner according to <16>, wherein the toner has a volume average particle diameter of 3 μm to 7 μm.

<18> The toner according to any of <16> or <17>, wherein the toner satisfies a ratio Dv/Dn of 1.2 or less, where Dv is a volume average particle diameter of the toner, and Dn is a number average particle diameter of the toner.

<19> The toner according to any one of <16> to <18>, wherein the toner contains a fraction of the toner having a particle diameter of 2 μm or less in an amount of 1% by number to 10% by number.

<20> The toner according to any one of <16> to <19>, wherein the toner has an acid value of 0.5 KOHmg/g to 40 KOHmg/g.

<21> The toner according to any one of <16> to <20>, wherein the toner has a glass transition temperature of 40° C. to 70° C.

<22> A developer containing the toner as defined in any one of <16> to <21>.

<23> A developer containing the toner as defined in any one of <16> to <21> and a carrier.

<24> An image forming apparatus, containing: a latent electrostatic image bearing member; a charging unit configured to charge a surface of the latent electrostatic image bearing member; an exposing unit configured to expose the charged surface of the latent electrostatic image bearing member and form a latent electrostatic image thereon; a developing unit configured to develop the latent electrostatic image with a toner to form a visible image; a transfer unit configured to transfer the visible image onto a recording medium to form a transfer image; and a fixing unit configured to fix the transfer image on the recording medium, wherein the toner is the toner as defined in any one of <16> to <21>.

<25> An image forming method, containing: charging a surface of a latent electrostatic image bearing member; exposing the charged surface of the latent electrostatic image bearing member and forming a latent electrostatic image thereon; developing the latent electrostatic image with a toner to form a visible image; transferring the visible image onto a recording medium to form a transfer image, and fixing the transfer image on the recording medium, wherein the toner is the toner as defined in any one of <16> to <21>.

<26> A process cartridge containing: at least a latent electrostatic image bearing member, and a developing unit configured to develop an latent electrostatic image formed on the latent electrostatic image bearing member with a toner to form a visible image, wherein the process cartridge is detachably mounted on a main body of an image forming apparatus, and the toner is the toner as defined in any one of <16> to <21>.

According to the present invention, it becomes possible to provide a toner having stable low-temperature fixing ability and anti-hot offset property and a method for producing the toner, as well as a developer containing the toner.

DETAILED DESCRIPTION OF THE INVENTION

Figure 1:
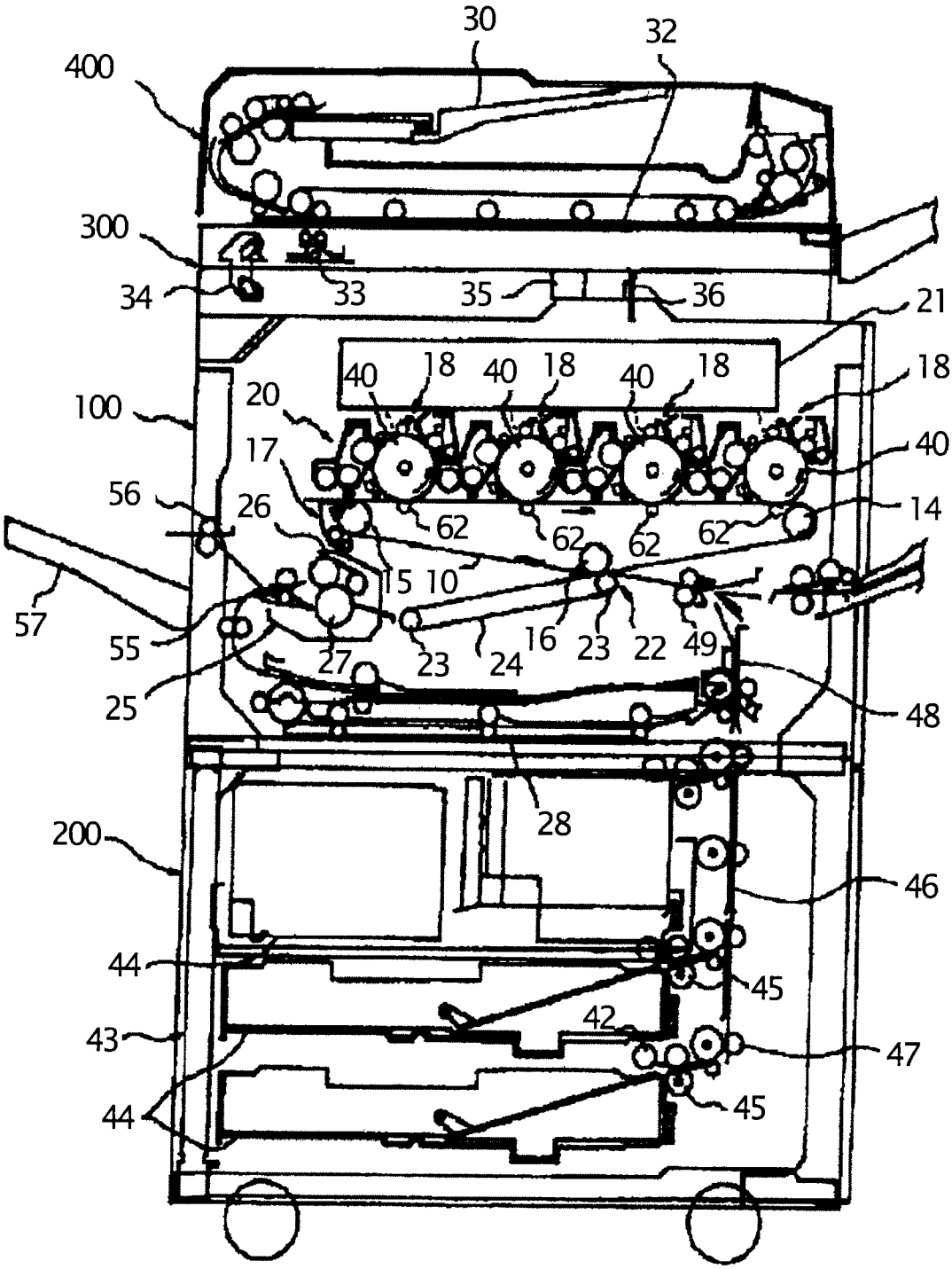
FIG. 1 is a view showing an example of an image forming apparatus according to the present invention.

The following is a description of embodiments of the present invention.

A method for producing a toner of the present invention contains: dispersing, in an aqueous medium, an oil phase which contains an organic solvent, and a binder resin component contained in the organic solvent, where the binder resin component contains a crystalline polyester resin and an amorphous polyester resin; and removing the organic solvent from the dispersion to obtain the toner, in which the dispersing further contains heating and dissolving the crystalline polyester and the amorphous polyester in the organic solvent to obtain a solution, cooling the solution so as to recrystallize the crystalline polyester resin, and mechanically pulverizing the recrystallized crystalline polyester resin so as to obtain a crystalline polyester dispersion. The crystalline polyester resin contained in the dispersion of the crystalline polyester has a volume average particle diameter of 0.1 μm to 1.0 μm.

According to this production method, it is possible to finely pulverize the crystalline polyester resin and to reduce the size of statistical dispersion of a particle size distribution of the toner by adjusting the volume average particle diameter of the crystalline polyester resin in the dispersion of the crystalline polyester to 0.1 μm to 1.0 μm, which makes it possible to achieve excellent low-temperature fixing ability using the toner.

The crystalline polyester resin is preferably dispersed in the dispersing step before it is added to the organic solvent forming the oil phase. It is preferred that the crystalline polyester dispersion obtained in the dispersing step is added to the oil phase.

The crystalline polyester resin in the toner of the present invention has a heat melting characteristic that the viscosity of the crystalline polyester resin falls sharply at temperatures near the temperature at which the toner begins to be fixed, due to high crystallinity of the crystalline polyester resin. That is, the crystalline polyester resin of the present invention has favorable heat-resistant storage stability due to its high crystallinity in the range of temperature below the temperature at which the crystalline polyester resin begins to be heat-melted, and the crystalline polyester resin shows a sharp fall in viscosity thereof (excellent sharp melting property) and thereby facilitates the fixation of the toner at the temperature at which the crystalline polyester resin begins to be heat-melted, which makes it possible to design a toner having both favorable heat-resistant storage stability and favorable low-temperature fixing ability. In addition, it is found that the crystalline polyester resin in the toner of the present invention has a favorable release width (the difference between the temperature of the lower limit for fixation and the temperature at which hot-offset occurs).

(Organic Solvent)

Examples of the organic solvent used in dispersing the crystalline polyester include that which permits complete dissolution of the crystalline polyester resin therein and thus formation of a homogeneous solution at high temperature, and, on the other hand, permits phase separation of the organic solvent and the crystalline polyester resin and thus formation of an opaque heterogeneous solution at low temperature when the solution is cooled.

The organic solvent is not particularly limited, as far as it is characteristically a poor solvent at a temperature below (Tm−40° C.), where Tm is a melting temperature of the crystalline polyester resin, and is characteristically a good solvent at a temperature of (Tm−40° C.) or higher, and may be appropriately selected depending on the intended purpose; examples thereof include toluene, ethyl acetate, butyl acetate, methyl ethyl ketone, and methyl isobutyl ketone. These may be used alone or in combination.

(Heat-Melting/Cooling of Crystalline Polyester Resin)

Thus, when the temperature of the crystalline polyester resin is increased in the organic solvent the crystalline polyester resin dissolves in the organic solvent, and when the crystalline polyester resin is cooled in the organic solvent, the crystalline polyester resin recrystallizes. However, it is important that, the crystalline polyester resin is heat melted and cooled in the organic solvent together with the amorphous polyester resin.

The diameter of the dispersed-phase particles of crystalline polyester resin crystals recrystallized by the cooling process depends on the concentration of the solution, rate of cooling, and compatibility with the amorphous polyester resin. When the crystalline polyester resin alone is dissolved in the organic solvent and then cooled therein, the size of the dispersed-phase particles of the crystalline polyester resin cannot be stabilized, resulting in production of irregularly-shaped particles having a large particle diameter. Production of particles having uniform and small particle diameters by the cooling process may be facilitated by heat melting the crystalline polyester resin together with an amorphous polyester resin or together with an amorphous polyester resin having partial compatibility with the crystalline polyester resin. In addition, the crystalline polyester particles show excellent stability with time when they have been heat melted together with an amorphous polyester resin or together with an amorphous polyester resin having partial compatibility with the crystalline polyester resin. When the diameter of the dispersed-phase particles of the crystalline polyester resin is larger than 1.0 μm, it is difficult to granulate the toner and a particle size distribution thereof may have a large size of statistical dispersion.

The higher the concentration of a crystalline polyester resin in the solution is, the larger the particle diameter of crystalline polyester resin crystals, which is recrystallized, becomes. However, when the particle diameter of the crystalline polyester resin crystals is increased by increasing the concentration of the solution, the efficiency of mechanical pulverization, to which the crystalline polyester resin crystals are subjected, is degraded. Conversely, the lower the concentration of a crystalline polyester resin in the solution is, the smaller the particle diameter of crystalline polyester resin crystals becomes. However, when the particle diameter of the crystalline polyester resin crystals is decreased by decreasing the concentration of the solution, the total production efficiency is degraded due to the low concentration of the dispersion to be obtained by cooling, though the efficiency of the mechanical pulverization is improved.

Preferably, a crystalline polyester resin and an amorphous polyester resin are added to and mixed in an organic solvent, both in an amount of 1% by mass to 20% by mass.

A ratio [crystalline polyester resin]/[amorphous polyester resin] is not particularly limited, may be appropriately selected depending on the intended purpose, and is preferably 10/90 to 90/10.

Preferably, a crystalline polyester resin and an amorphous polyester resin are added to an organic solvent to prepare a mixture, the mixture is stirred for about 30 minutes at the temperature of the boiling point or lower of the organic solvent under a normal pressure to prepare a transparent homogeneous solution, and the homogeneous solution is cooled at a temperature decrease rate of 0.1° C./min to 30° C./min.

(Mechanical Pulverization)

Examples of a mechanical pulverizer used for finely, mechanically pulverizing the crystalline polyester resin crystal recrystallized by the cooling process include those pulverizers which are commercially available, such as bead mill, ball mill, and wet-type micro pulverizer (Ultimizer, manufactured by Sugino Machine Limited).

(Crystalline Polyester Resin)

The crystalline polyester resin is not particularly limited, may be appropriately selected depending on the intended purpose; preferable examples thereof include the crystalline polyester resin having a structure represented by the following general formula (1), which can be synthesized using an alcohol component and an acid component. Examples of the alcohol component include a C2-C6 diol compound, preferably which contains 80 mol % or more, preferably 85 mol % to 100 mol % of at least one selected from the group consisting of 1,4-butanediol, 1,6-hexanediol, and a derivative thereof. Examples of the acid component include at least one selected from the group consisting of fumaric acid, a carboxylic acid having a double bond (C=C bond), and a derivative thereof.

$$[-O-CO-(CR^1=CR^2)_l-CO-O-(CH_2)_n-]_m \qquad \text{General Formula (1),}$$

In the general formula (1) above, n and m each represent the number of respective repeating units, 1 represents an integer from 1 to 3, $R^1$ and $R^2$ each represent one of a hydrogen atom and a hydrocarbon group and may be identical to or different from each other.

The crystallinity and the softening point of the crystalline polyester resin may be controlled, for example, by designing and employing a nonlinear polyester produced by polycondensation using an alcohol component to which, further, a trihydric or higher polyhydric alcohol such as glycerin is added and an acid component to which, further, a trivalent or higher polycarboxylic acid such as trimellitic anhydride is added during the synthesis of the polyester.

The molecular structure of a crystalline polyester resin of the present invention may be confirmed, for example, by NMR measurement of the crystalline polyester resin in solution or as a solid, as well as by measurement of the crystalline polyester resin using X-ray diffraction, GC/MS, LC/MS, and IR, and simply by identification of the absorption peaks indicating olefin's ξCH (out-of-plane deformation vibration) which are located at 965 $cm^{-1}$±10 $cm^{-1}$ and 990 $cm^{-1}$±10 $cm^{-1}$ in the infrared absorption spectrum.

Furthermore, a polyester resin is recognized as crystalline if it exhibits diffraction peaks, and as amorphous if it does not exhibit clear diffraction peaks, when it is subjected to X-ray diffraction measurement.

In view of the fact that a crystalline polyester resin having a molecular weight distribution with a small size of statistical dispersion and having a low molecular weight is excellent in achieving low-temperature fixing ability, preferably the crystalline polyester resin has a peak in the range of 3.5 to 4.0 on a log (M) scale, the half width of the peak of 1.5 or shorter on a log (M) scale, a weight average molecular weight (Mw) of 1,000 to 30,000, a number average molecular weight (Mn) of 500 to 6,000, and a ratio Mw/Mn of 2 to 10, when a molecular weight distribution of the crystalline polyester resin is obtained by subjecting to GPC the fraction of the crystalline polyester resin soluble in o-dichlorobenzene for subsequent analysis and the molecular weight distribution is expressed as a graph where the horizontal axis is given on a log (M) scale and the vertical axis is given on a % by weight scale.

Preferably, the melting temperature and the F½ temperature of the crystalline polyester resin is low, as far as the heat-resistant storage stability is not impaired, and preferably the temperature of the endothermic peak measured with DSC is in the range of 50° C. to 130° C. When the temperature of the endothermic peak measured with DSC is lower than 50° C., the heat-resistant storage stability may be degraded, and blocking may readily occur even at a temperature of the inside of the developing device. When the temperature of the endothermic peak measured by DSC is higher than 130° C., sufficient low-temperature fixing ability may not be obtained because the lower limit temperature for fixation becomes high.

—Softening Temperature (F½ Temperature)—

The softening temperature (F½ temperature) indicates meltability of a resin. When the F½ temperature is high, the meltability of the resin is degraded, which results in increase in heat required for melting the resin. On the other hand, when the F½ temperature is low, the meltability of the resin is improved, which results in decrease in heat required for melting the resin.

The F½ temperature is measured as follows.

A sample with a volume of 1 $cm^3$ is melted and allowed to flow using a Koka-type flowtester (CFT-500, manufactured by Shimadzu Corporation) under the following conditions: diameter of die: 1 mm; pressure applied: 10 $kg/cm^2$; and rate of increase in temperature: 3° C./min. Then, the temperature, at which half of the amount of the sample that has flowed from the flow starting time to the flow ending time is considered to have flowed, is extrapolated and defined as the F½ temperature of the sample.

—Melting Temperature (DSC Endothermic Peak Temperature)—

A melting temperature is defined as the temperature at which the maximum endothermic peak occurs when a sample is subjected to a differential scanning calorimeter.

An acid value of a crystalline polyester resin is not particularly limited, may be appropriately selected depending on the intended purpose, and is preferably 5 mgKOH/g or higher, and more preferably 10 mgKOH/g or higher from the view point of increasing the affinity of the resin with paper and of achieving the intended low-temperature fixing ability, and is preferably 45 mgKOH/g or lower from the view point of improving anti-hot offset property. Furthermore, the hydroxyl value of a crystalline polymer is preferably 0 mgKOH/g to 50 mgKOH/g, and more preferably 5 mgKOH/g to 50 mgKOH/g for achieving both the predetermined degree of low-temperature fixing ability and favorable charging property.

(Amorphous Polyester Resin)

The amorphous polyester resin is a non-crystalline resin.

The softening temperature (F½ temperature) of an amorphous polyester resin is not particularly limited, may be appropriately selected depending on the intended purpose, and is preferably 120° C. to 160° C., and more preferably 130° C. to 150° C.

The Tg of an amorphous polyester resin is not particularly limited, may be appropriately selected depending on the intended purpose, and is preferably 35° C. to 70° C., and more preferably 45° C. to 65° C.

The weight average molecular weight (Mw) of particles of an amorphous polyester resin is, when it is represented by the Mw of the fraction of the amorphous polyester resin soluble in THF, preferably 3,000 to 100,000, and more preferably 6,000 to 80,000.

The number average molecular weight (Mn) of particles of an amorphous polyester resin is not particularly limited, may be appropriately selected depending on the intended purpose, and is, when it is represented by the Mn of the fraction of the amorphous polyester resin soluble in THF, preferably 1,500 to 4,000, and more preferably 1,800 to 4,000.

A ratio Mw/Mn of particles of an amorphous polyester resin is not particularly limited, may be appropriately selected depending on the intended purpose, and is preferably 2 to 50, and more preferably 4 to 40.

The molecular structure of an amorphous polyester resin is not particularly limited, as far as the molecular structure contains an amorphous structure, and may be appropriately selected depending on the purpose; for the amorphous polyester resin, amorphous polyesters which are commonly used for toner binder resins and which show various structures may be used, however, in the present invention for the amorphous polyester resin those amorphous polyesters which contain ester bonds represented by the following general formula (2) in the backbone of the molecule in an amount of at least 60 mol % are preferable:

$$—OOC—R^1—COO—R^2— \qquad \text{General Formula (2)}$$

where $R^1$ and $R^2$ each represent a bivalent hydrocarbon group having 2 to 20 carbon atoms.

The bivalent hydrocarbon group $R^1$ is not particularly limited, as far as it provides an amorphous polyester resin, and may be appropriately selected depending on the purpose; examples thereof include a bivalent carboxylic acid group, and in particular a group derived from a bivalent carboxylic acid, such as fumaric acid, terephthalic acid, and dodecenyl succinic anhydride is preferable.

The bivalent hydrocarbon group is not particularly limited, may be appropriately selected depending on the intended purpose; examples thereof include a bivalent aliphatic hydrocarbon group and a bivalent aromatic hydrocarbon group.

The bivalent aliphatic hydrocarbon group is not particularly limited, may be appropriately selected depending on the intended purpose; examples thereof include an alkylene group having 2 to 20 carbon atoms (preferably 2 to 14 carbon atoms), and a cycloalkylene group having 4 to 12 carbon atoms (preferably 6 to 8 carbon atoms).

The bivalent aromatic hydrocarbon group is not particularly limited, may be appropriately selected depending on the intended purpose; examples thereof include an arylene group having 6 to 14 carbon atoms (preferably 6 to 12 carbon atoms), and an arylene-dialkylene group having 8 to 12 carbon atoms.

The $R^2$ represents a dihydric alcohol group. The dihydric alcohol group is not particularly limited, may be appropriately selected depending on the intended purpose; examples thereof include a residue derived from a known dihydric aliphatic alcohol or a known dihydric aromatic alcohol, such as a residue derived from an aliphatic diol, such as an alkylene diol having 2 to 14 carbon atoms (preferably 2 to 12 carbon atoms) and a cycloalkylalkylene diol having 5 to 14 carbon atoms (preferably 6 to 8 carbon atoms).

The dihydric alcohol residue is not particularly limited, may be appropriately selected depending on the intended purpose, and includes, for example, a residue derived from an arylenedialkylenediol having 8 to 18 carbon atoms (preferably 8 to 15 carbon atoms), and a residue derived from a diol represented by the following general formula (3):

General Formula (3)

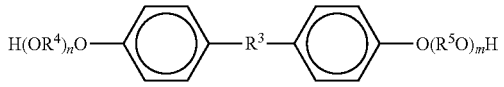

where $R^3$ represents an alkylene group having 1 to 6 carbon atoms; $R^4$ and $R^5$ each represent an alkylene group having 2 to 4 carbon atoms; n and m each represent an integer of 1 to 16, and preferably 2 to 14.

The dihydric alcohol (diol) represented by the above General Formula (3) is not particularly limited, and may be appropriately selected depending on the intended purpose; examples thereof include a propylene oxide adduct of bisphenol A and an ethylene oxide adduct of bisphenol A.

Preferably, at least one of the bivalent carboxylic acid component and dihydric alcohol component in the amorphous polyester resin contains an aromatic ring. Furthermore, in order to achieve sufficient anti-hot offset property, preferably, an amorphous polyester resin which forms a gel insoluble in chloroform is used. In this instance, the proportion of the gel is 2% by mass to 40% by mass, and preferably 5% by mass to 30% by mass.

The amorphous polyester resin used in the present invention may contain an aromatic ring component in the backbone of the molecule in an amount of 30 mol % to 100 mol %, preferably 50 mol % to 100 mol %, and more preferably 60 mol % to 100 mol %, based on the total amount of ester bonds.

The amorphous polyester resin may be produced by polycondensing, in the usual manner, (i) a polycarboxylic acid component composed of a bivalent carboxylic acid or a reactive derivative thereof (e.g., an acid anhydride thereof, a lower alkyl (C1 to C4) ester thereof, and an acid halide thereof) with (ii) a polyalcohol component selected from dihydric alcohols. In this case, the polycarboxylic acid component may contain, as required, a small amount of trivalent or higher polycarboxylic acid. The trivalent or higher polycarboxylic acid is not particularly limited, may be appropriately selected depending on the intended purpose; examples thereof include a trivalent aromatic carboxylic acid (e.g., a trimellitic anhydride). Such trivalent or higher polycarboxylic acid may be usually added in an amount of 30 mol % or less, preferably 20 mol % or less, and more preferably 10 mol % or less, based on the total amount of carboxylic acid.

The polyalcohol component may contain, as required, a small amount of trihydric or higher polyhydric alcohol (e.g., glycerin). Such trihydric or higher polyhydric alcohol may be added in an amount of 20 mol % or less, and preferably 10 mol % or less, based on the total amount of alcohol.

The amorphous polyester resin is a polyester resin which is noncrystalline. When a polyester resin is subjected to an X-ray diffraction analysis and there appears no diffraction peak at positions where 2θ is 20° to 25° in an X-ray diffraction pattern, the polyester resin is regarded as amorphous.

Preferably, the binder resin component contains a precursor of a binder resin.

Further, the method for producing a toner according to the present invention is preferably a method for producing the toner, wherein a precursor of binder resin composed of at least a colorant, a releasing agent, a dispersion of the crystalline polyester, and a modified polyester resin, and the other binder resin components are dissolved and dispersed in an organic solvent to prepare an oil phase, a compound capable of propagating and cross-linking the precursor of binder resin is dissolved in the oil phase, the resultant oil phase is dispersed in an aqueous medium in the presence of a particulate dispersant to prepare an emulsified dispersion, the precursor of binder resin is subjected to at least one of a cross-linking reaction and an extension reaction in the emulsified dispersion, and then the organic solvent is removed from the resultant emulsified dispersion that has undergone one of the cross-linking reaction and the extension reaction of the precursor of binder resin.

(Precursor of Binder Resin)

The precursor of binder resin is preferably a precursor of binder resin that is composed of a modified polyester resin, and examples thereof include a polyester prepolymer modified with an isocyanate group or an epoxy group. The precursor of binder resin is reacted with a compound having an active hydrogen group (such as an amine) to be propagated, and has a considerable effect on improvement of release width (the difference between the temperature of the lower limit for fixation and the temperature at which hot-offset occurs). This polyester prepolymer may be readily synthesized by reacting a polyester resin as a base material with one of a known isocyanating agent and a known epoxidizing agent. The isocyanating agent is not particularly limited, may be appropriately selected depending on the intended purpose; examples thereof include aliphatic polyisocyanates such as tetramethylene diisocyanate, hexamethylene diisocyanate, and 2,6-diisocyanatomethylcaproate; alicyclic polyisocyanates such as isophorone diisocyanate, and cyclohexylmethanediisocyanate; aromatic diisocyantes such as tolylene diisocyanate and diphenylmethane diisocyante; aromatic aliphatic diisocyanates such as $\alpha,\alpha,\alpha',\alpha'$-tetramethyl xylylene diisocyanate; isocyanurates; the polyisocyantes whose isocyanate groups are blocked with a phenol derivative, an oxime, and a caprolactam, and the like. These may be used alone or in combination.

Examples of an epoxidizing agent include epichlorohydrine.

A mixing ratio of the isocyanating agent and the polyester, quantified as an equivalent ratio [NCO]/[OH] of isocyanate groups [NCO] to hydroxyl groups [OH] of the polyester as a base material, is normally 5/1 to 1/1, preferably 4/1 to 1.2/1, and more preferably 2.5/1 to 1.5/1. When an equivalent ratio [NCO]/[OH] is higher than 5, the low-temperature fixing ability of the toner may be degraded. When a molar ratio of the [NCO] is lower than 1, anti-hot offset property of the toner may be degraded because the urea content of this polyester prepolymer is reduced.

The amount of the isocyanating agent in this polyester prepolymer is not particularly limited, may be appropriately selected depending on the intended purpose, and is preferably 0.5% by mass to 40% by mass, more preferably 1% by mass to 30% by mass, and particularly preferably 2% by mass to 20% by mass. When the amount of an isocyanating agent in the prepolymer is less than 0.5% by mass, anti-hot offset property of the toner may be degraded, and achievement of both heat-resistant storage stability and low-temperature fixing ability in a balanced manner may become difficult. When the amount of an isocyanating agent in the prepolymer is more than 40% by mass, low-temperature fixing ability of the toner may be degraded.

The number of an isocyanate group contained in a molecule of this polyester prepolymer is usually 1 or more, preferably 1.5 to 3 when expressed as mean values, and more preferably 1.8 to 2.5 when expressed as mean values. When the mean number of an isocyanate group per prepolymer molecule is less than 1, the molecular weight of the urea modified polyester resin after the chain extension reaction may be reduced and thereby the anti-hot offset property of the toner may be degraded.

Preferably, the precursor of binder resin has a weight average molecular weight of $1\times10^4$ to $3\times10^5$.

(Compound Capable of Propagating or Cross-Linking Precursor of Binder Resin)

Examples of a compound capable of propagating or cross-linking the precursor of binder resin include a compound having an active hydrogen group, such as amines for a representative example. The amines are not particularly limited, and may be appropriately selected depending on the intended purpose; examples thereof include diamine compounds, trivalent or more polyamine compounds, amino alcohol compounds, aminomercaptan compounds, amino acid compounds and the above-mentioned amine compounds whose amino groups are blocked. Examples of diamine compounds include aromatic diamines, such as phenylenediamine, diethyltoluenediamine, and 4,4'-diaminodiphenylmethane; alicyclic diamines, such as 4,4'-diamino-3,3'-dimethyldicyclohexylmethane, diaminocyclohexane, and isophoronediamine; and aliphatic diamines, such as ethylenediamine, tetramethylenediamine, and hexamethylenediamine. The trivalent or more polyamine compounds are not particularly limited, and may be appropriately selected depending on the intended purpose; examples thereof include diethylenetriamine, and triethylenetetraamine. The amino alcohol compounds are not particularly limited, and may be appropriately selected depending on the intended purpose; examples thereof include ethanolamine, and hydroxyethylaniline. Examples of the aminomercaptan compounds include aminoethylmercaptan and aminopropylmercaptan.

The amino acid compounds are not particularly limited, and may be appropriately selected depending on the intended purpose; examples thereof include aminopropionic acid, and aminocaproic acid.

The above-mentioned amine compounds whose amino groups are blocked are not particularly limited, and may be appropriately limited depending on the intended purpose; examples thereof include ketimine compounds and oxazoline compounds obtained from the above-mentioned amine compounds and ketones such as acetone, methylethylketone, and methyl isobutyl ketone. Preferably, diamine compounds and mixtures of diamine compounds and a small amount of polyamine compounds are used among these amine compounds.

(Colorant)

For a colorant of the toner of the present invention, any known dye or pigment may be used; and examples of the colorant include carbon black, nigrosine dyes, iron black, naphthol yellow S, hanza yellow (10G, 5G, G), cadmium yellow, yellow iron oxide, yellow ocher, chrome yellow, titanium yellow, polyazo yellow, oil yellow, hanza yellow (GR, A, RN, R), pigment yellow L, benzidine yellow (G, GR), permanent yellow (NCG), Balkan fast yellow (5G, R), tartrazine lake, quinoline yellow lake, anthrazane yellow BGL, isoindolinone yellow, colcothar, red lead, lead vermillion, cadmium red, cadmium mercury red, antimony vermillion, permanent red 4R, parared, faicer red, parachloroorthonitroaniline red, lithol fast scarlet G, brilliant fast scarlet, brilliant carmine BS, permanent red (F2R, F4R, FRL, FRLL, F4RH), fast scarlet VD, Balkan fast rubine B, brilliant scarlet G, lithol rubine GX, permanent red F5R, brilliant carmine 6B, pigment scarlet 3B, Bordeaux 5B, toluidine maroon, permanent Bordeaux F2K, helio Bordeaux BL, Bordeaux 10B, bon maroon light, bon maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, non-metallic phthalocyanine blue, phthalocyanine blue, fast sky blue, indanthrene blue (RS, BC), indigo, ultramarine blue, Prussian blue, anthraquinone blue, fast violet B, methyl violet lake, cobalt violet, manganese violet, dioxane violet, anthraquinone violet, chrome green, zinc green, chromium oxide, pyridian, emerald green, pigment green B, naphthol green B, green gold, acid green lake, malachite green lake, phthalocyanine green, anthraquinone green, titanium oxide, zinc flower, lithopone, and a mixture thereof. The amount of the colorant in the toner is usually 1% by mass to 15% by mass, and preferably 3% by mass to 10% by mass.

The colorant used in the present invention may be mixed with a resin to be formed into a master batch for use in the present invention. The binder resin for use in production of the master batch or for use as a component of the master batch which is kneaded with the master batch is not particularly limited, and may be appropriately selected depending on the intended purpose; and examples thereof include, in addition to the above-mentioned modified polyester resin and unmodified polyester resin, polymers composed of styrene or its substitution product such as polystyrene, poly (p-chlorostyrene), and polyvinyl toluene; styrene copolymers such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleic acid ester copolymers;. polymethyl methacrylate, polybutyl methacrylate, polyvinyl chloride, polyvinyl acetate, polyethylene, polypropylene, polyesters, epoxy resins, epoxy/polyol resins, polyurethane, polyamides, polyvinyl butyral, polyacrylic acid resins, rosin, modified rosins, terpene resins, aliphatic hydrocarbon resins or alicyclic hydrocarbon resins, aromatic petroleum resins, chlorinated paraffins, and paraffin waxes. These may be used alone or combined for use as a mixture.

The present master batch may be prepared by mixing and kneading a master batch resin and a master batch colorant using high shearing force. In the preparation of the present master batch, an organic solvent may be used for increasing the interaction between the colorant and the resin. For preparing the master batch, a so-called flushing method including at least mixing and kneading an aqueous paste containing a colorant together with a resin and an organic solvent, allowing the colorant together to permeate into the resin side, and removing moisture and an organic solvent component, is preferably used, because the resultant wet cake of the colorant may be directly used without drying. Preferably, a high shear dispersing device, such as a three roll mill may be used for mixing and kneading the aqueous paste.

(Releasing Agent)

The melting temperature of a releasing agent is not particularly limited, may be appropriately selected depending on the intended purpose, and is preferably 50° C. to 120°, when the releasing agent is a wax, which is preferably.

Such wax may efficiently act as a releasing agent between a fixing roller and an interface of the toner, resulting in improvement of the anti-hot offset property without applying a releasing agent such as oil to the fixing roller.

Note that the melting point of the wax is determined by locating the maximum endothermic peak detected by means of a differential scanning calorimeter (TAS-100 of TG-DSC system, manufactured by IPROS CORPORATION).

The releasing agent is not particularly limited, may be appropriately selected depending on the intended purpose; examples thereof include waxes such as, plant-derived waxes, for example, carnauba waxes, cotton waxes, Japan waxes, and rice waxes; animal-derived waxes, for example, bees waxes and lanolin; mineral waxes, for example, ozocerite, and ceresin; and petroleum waxes, for example, paraffin, microcrystalline wax, and petrolatum.

The releasing agent other than these natural waxes are not particularly limited, and may be appropriately selected depending on the intended purpose; examples thereof include synthetic hydrocarbon waxes such as Fischer-Tropsch waxes, and polyethylene waxes; and synthetic waxes such as esters, ketones, and ethers.

Furthermore, fatty acid amides such as 1,2-hydroxy stearic acid amide, stearic acid amide, phthalimide, and chlorinated hydrocarbon; and crystalline polymers in which low-molecular weight crystalline polymers (e.g. homopolymer or copolymer of polyacrylate) each having a long alkyl chain as a side chain can be used as the releasing agent. Examples of the polyacrylate mentioned above include poly(n-stearyl methacrylate), and poly(n-lauryl methacrylate). The copolymer of the polyacrylate mentioned above is, for example, n-staeryl acrylate-ethyl methacrylate copolymer.

(Charge Controlling Agent)

A toner according to the present invention may contain a charge controlling agent as required. The charge controlling agent is not particularly limited and can be selected from those known publicly; examples thereof include nigrosine based dyes, triphenylmethane based dyes, chromium containing metal complex dyes, molybdic acid chelate pigments, rhodamine based dyes, alkoxy based amines, quaternary ammonium salts (including fluorine modified quaternary ammonium salts), alkyl amide, a simple substance of phosphorus or compounds thereof, a simple substance of tungsten or compounds thereof, fluorine based active agents, metal salts of salicylic acid and metal salts of salicylate derivatives.

Specifically, the examples of the charge controlling agent include BONTRON 03 of the nigrosine based dye, BONTRON P-51 of the quaternary ammonium salt, BONTRON S-34 of the metal-containing azo dye, E-82 of oxynaphthoic acid-based metal complex, E-84 of salicylic acid-based metal complex, E-89 of phenol-based condensate (manufactured by Orient Chemical Industries Ltd.); TP-302 and TP-415 of a quaternary ammonium salt molybdenum complex (manufactured by Hodogaya Chemical Co., Ltd.); Copy Charge PSY VP2038 of the quaternary ammonium salt, Copy Blue PR of the triphenylmethane derivative, Copy Charge NEG VP2036 and Copy Charge NX VP434 of the quaternary ammonium salt (manufactured by Hoechst); LRA-901, and LR-147 which is a boron complex (manufactured by Japan Carlit Co., Ltd.); copper phthalocyanine, perylene, quinacridone, azo-based pigments, and polymer compounds having functional groups such as sulfonic acid group, carboxyl group, and quaternary ammonium salt.

The amount of the charge controlling agent in the toner varies depending on the type of the binder resin, the presence or absence of the additive used as required, and the production method of the toner including dispersion method, can not be primarily defined, but is preferably 0.1 parts by mass to 10 parts by mass and more preferably 0.2 parts by mass to 5 parts by mass relative to 100 parts by mass of the binder resin. When the amount is more than 10 parts by mass, the chargeability of the toner becomes too large, the effect of the major charge controlling agent is reduced, and an electrostatic suction force onto the developing roller is increased, sometimes resulting in degradation of fluidity of the developer and degradation of the image density. These charge controlling agents may be melted and kneaded with a master batch and a resin, and then the melt-kneaded product is dissolved and dispersed in a medium for use in a toner, or, of course, may be added when the master batch and the resin are directly dissolved and dispersed in an organic solvent, or may be fixed on a surface of the toner after toner particles are formed.

(Unmodified Polyester Resin)

In the present invention, an amorphous unmodified polyester resin may be used for a binder resin component. A modified polyester resin prepared by a cross-linking and/or propagating reaction of a precursor of binder resin composed of a modified polyester resin is preferably at least partly compatible with an unmodified polyester resin. By this compatibility of the modified polyester resin produced by cross-linking and/or propagation with an unmodified polyester resin, the low-temperature fixing ability and the anti-hot offset property may be improved. In order to achieve this compatibility of the modified polyester resin produced by cross-linking and/or propagation with an unmodified polyester resin, the modified polyester rein and the unmodified polyester resin are preferably composed of similar compositions of a polyol and a polycarboxylic acid. Furthermore, an amorphous polyester resin incorporated in a formulation of a dispersion of crystalline polyester may be used as an unmodified polyester resin, as far as it is unmodified.

The acid value of an unmodified polyester resin is usually 1 KOH mg/g to 50 KOH mg/g, and preferably 5 KOHmg/g to 30 KOHmg/g. When the acid value is 1 KOHmg/g or more, the toner produced with the unmodified polyester resin tends to have high negative chargeability, the affinity of a toner with paper becomes strong when the toner is fixed on the paper, resulting in improvement of low-temperature fixing ability. However, when the acid value is higher than 50 KOHmg/g, the charge stability, especially, charge stability over changing environment may be degraded. Preferably, the unmodified polyester resin used in the present invention has an acid value of 1 KOHmg/g to 50 KOHmg/g.

The hydroxyl value of an unmodified polyester resin is preferably 5 KOHmg/g or more.

A hydroxyl value is determined by a method in accordance with JIS K0070-1966.

Specifically, the procedure of the method is as follows. First, precisely 0.5 g of a sample is placed in a 100-mL measuring flask, and 5 mL of an acetylating agent is added to the 100-mL measuring flask. Subsequently, the measuring flask is heated in a hot bath at 100° C.±5° C. for 1 hour to 2 hours, and then the measuring flask is removed from the hot bath and cooled. Further, water is added to the measuring flask, and the flask is shaken to break down acetic anhydride thus formed. Next, in order to completely break down acetic anhydride, the measuring flask containing the acetic anhydride is again heated in the hot bath for more than 10 minutes and then left for cooling, and the wall of the measuring flask is sufficiently washed with an organic solvent.

Furthermore, a hydroxyl value is determined at 23° C. by means of an electrical potential difference type automatic titration device (DL-53 TITRATOR, manufactured by Mettler-Toledo International Inc.) with an electrode (DG113-SC, manufactured by Mettler-Toledo International Inc.), and the hydroxyl value thus determined is analyzed using an analysis software LabX Light Version 1.00.000. For calibrating the device, a solvent mixture of 120 mL toluene and 30 mL ethanol is used.

The measurement conditions of the above-mentioned procedure are as follows:

Stir,
- Speed [%]: 25
- Time [s]: 15

EQP titration,
- Titrant/Sensor,
  - Titrant: $CH_3ONa$
  - Concentration [mol/L]: 0.1
  - Sensor: DG115
  - Unit of measurement: mV
- Predispensing to volume
  - Volume [mL]: 1.0
  - Wait time [s]: 0
- Titrant addition: Dynamic
  - dE (set) [mV]: 8.0
  - dV (min) [mL]: 0.03
  - dV (max) [mL]: 0.5
- Measure mode: Equilibrium controlled
  - dE [mV]: 0.5
  - dt [s]: 1.0
  - t (min) [s]: 2.0
  - t (max) [s]: 20.0
- Recognition,
  - Threshold: 100.0
  - Steepest jump only: No,
  - Range: No
  - Tendency: None
- Termination,
  - at maximum volume [mL]: 10.0
  - at potential: No
  - at slope: No
  - after number EQPs: Yes, n=1
  - comb.termination conditions: No
- Evaluation,
  - Procedure: Standard
  - Potential1: No
  - Potential2: No
  - Stop for reevaluation: No Note that a urea-modified polyester resin may be used in combination with, in addition to the unmodified polyester resin, a polyester resin modified with a chemical bond other than urea bond, such as a polyester resin modified with a urethane bond.

When a toner composition contains a modified polyester resin, such as a urea-modified polyester resin, the modified polyester resin may be produced by a one-shot method and the like.

For example, a method for producing a urea-modified polyester resin will be described below.

First, while water produced in a reaction system is removed, a polyol and a polycarboxylic acid are heated at 150° C. to 280° C. under a reduced pressure of the reaction system, in the presence of catalysts such as tetrabutoxy titanate and dibutyl tin oxide to prepare a polyester resin having hydroxyl groups. Subsequently, a polyester resin having hydroxyl groups is reacted with a polyisocyanate at 40° C. to 140° C. to prepare a polyester prepolymer having isocyanate groups. Further, the polyester prepolymer having isocyanate groups is reacted with an amine at 0° C. to 140° C. to prepare a urea-modified polyester resin.

The number average molecular weight of the urea-modified polyester resin is usually 1,000 to 10,000, and preferably 1,500 to 6,000.

Note that for reacting a polyester resin having hydroxyl groups with a polyisocyanate and for reacting a polyester prepolymer having an isocyanate group with an amine, a solvent may be used as well as required.

Examples of the solvent include those inactive solvents for reacting with an isocyanate group, such as aromatic solvents (e.g. toluene and xylene), ketones (e.g. acetone, methyl ethyl ketone, and methyl isobutyl ketone), esters (e.g. ethyl acetate), amides (e.g. dimethylformamide and dimethylacetoamide), and ethers (e.g. tetrahydrofuran).

Note that in order to use an unmodified polyester resin with the urea-modified polyester resin, the unmodified polyester resin that has been prepared in the same manner as in the production of the polyester resin having a hydroxyl group may be incorporated in a solution of the urea-modified resin which has undergone the modification reaction with an amine.

The binder resin component contained in an oil phase in the present invention may be a combination of the crystalline polyester resin, the amorphous polyester resin, the precursor of binder resin, and the unmodified polyester resin, however, the combination may further include other binder resin. Preferably, the binder resin component contains polyester resins, and more preferably polyester resins in an amount of 50% by mass or more. When the amount of polyester resins contained in the binder resin component is less than 50% by mass, the low-temperature fixing ability may be degraded. Particularly preferably, any one of the binder resin component is polyester resin.

Note that a component of the binder resin component that is not polyester resin is not particularly limited, and may be appropriately selected depending on the intended purpose; example thereof include polymers composed of styrene or its substitution product such as polystyrene, poly (p-chlorostyrene), and polyvinyltoluene; styrene copolymers such as styrene-p-chlorostyrene copolymers, styrene-propylene copolymers, styrene-vinyl toluene copolymers, styrene-vinyl naphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, and styrene-maleic acid ester copolymers;. polymethylmethacrylate, polybutylmethacrylate, polyvinylchloride, polyvinylacetate, polyethylene, polypropylene, epoxy resins, epoxy polyol resins, polyurethane, polyamides, polyvinyl butyral, polyacrylic acid resins, rosin, modified rosins, terpene resins, aliphatic hydrocarbon resins or alicyclic hydrocarbon resins, aromatic petroleum resins, chlorinated paraffin, and paraffin waxes.

(Method for Producing Toner in an Aqueous Medium)

The aqueous medium used in the present invention may be water alone or water in combination with a solvent miscible with water. Examples of the solvent miscible with water include alcohol (such as methanol, isopropanol, and ethylene glycol), dimethylformamide, tetrahydrofuran, celsolves (such as methylcelsolve), lower ketones (such as acetone and methyl ethyl ketone).

A precursor of binder resin, a colorant, a releasing agent, a dispersion of crystalline polyester, a charge controlling agent, and an unmodified polyester resin of which a toner particle is composed may be mixed during the formation of a dispersion in an aqueous medium, however, preferably after previously these toner raw materials has been mixed, the mixture is added to and dispersed in the aqueous medium. Furthermore, in the present invention, toner raw materials other than the binder resin component, such as a colorant, a releasing agent, and a charge controlling agent are not necessarily previously incorporated during the formation of particles in an aqueous medium, however, they may be added to particles which have been formed without the toner raw materials other than the binder resin component. For example, after particles that do not contain a colorant are formed, the colorant may be added to the particles by a known method for dyeing.

A method for dispersing is not particularly limited, however, known devices based on low-speed shear method, high-speed shear method, friction method, high-pressure jet method, and ultrasonic method, and the like can be used. Among these devices, a device based on a high-speed shear method is preferably used to provide a dispersion particle of diameter from 2 μm to 20 μm. When such a high-speed shear dispersing device is used, the number of revolutions per minute is not particularly limited, and may be appropriately selected depending on the intended purpose, however, it is usually 1,000 rpm to 30,000 rpm, and preferably 5,000 rpm to 20,000 rpm. Length of time for the dispersion is not particularly limited, and may be appropriately selected depending on the intended purpose, however, it is usually preferably 0.1 minutes to 60 minutes in the case of using a batch method. The temperature during the dispersion is usually 0° C. to 80° C. (under increased pressure), and preferably 10° C. to 40° C.

The amount of the aqueous medium for use is usually 100 parts by mass to 1,000 parts by mass relative to 100 parts by mass of a toner composition. When the amount is less than 100 parts by mass, the dispersion state of the toner composition is insufficient and toner particles having predetermined particle diameters sometimes can not be obtained. When the amount is more than 1,000 parts by mass, it may not be economical.

Furthermore, a dispersant may be used as required. The dispersant is preferably used in terms of producing a sharp particle size distribution as well as a stable dispersion.

Method for reacting the polyester prepolymer with a compound having an active hydrogen group may be a method of adding and reacting the compound having an active hydrogen group before dispersing the toner composition in an aqueous medium or may be a method of adding the compound having an active hydrogen group after the toner composition has been dispersed in the aqueous medium and of reacting the compound from the interface of particles. In the latter case, modified polyesters are produced from a polyester prepolymer preferentially on the surface of the toner produced, and it is possible to provide a concentration gradient inside the particles.

The dispersant used for emulsifying or dispersing an oil phase, in which the toner composition is dispersed, in a liquid containing water is not particularly limited, and may be appropriately selected depending on the intended purpose; examples thereof include anionic surfactants such as alkylbenzene sulfonate, α-olefin sulfonate, and phosphate ester; cationic surfactants such as an amine salt type (for example, alkylamine salt, aminoalcohol fatty acid derivative, polyamine fatty acid derivative, and imidazoline) and a quaternary ammonium salt surfactant (for example, alkyltrimethyl ammonium salt, dialkyldimethyl ammonium salt, alkyldimethylbenzyl ammonium salt, pyridinium salt, alkylisoquinolinium salt, benzethonium chloride); nonionic surfactants such as fatty acid amide derivative and polyalcohol derivative; and ampholytic surfactants such as alanine, dodecyldi(aminoethyl)glycine, di(octylamioethyl)glycine, and N-alkyl-N,N-dimethyl ammonium betaine.

Alternatively, use of the surfactant having a fluoroalkyl group improves the effect thereof even with a very small amount. The surfactant having a fluoroalkyl group is preferably an anionic surfactant having a fluoroalkyl group. Examples of the anionic surfactant having a fluoroalkyl group include fluoroalkylcarboxylic acid having 2 to 10 carbon atoms and a metal salt thereof, disodium perfluorooctanesulfonylglutamate, sodium 3-[ω-fluoro(C6-C11)alkyloxy]-1-(C3-C4)alkyl sulfonate, sodium 3-[ω-fluoro(C6-C8)alkanoyl-N-ethylamino]-1-propanesulfonate, fluoro(C11-C20)alkylcarboxylic acid and a metal salt thereof, perfluoro(C7-C13)alkylcarboxylic acid and a metal salt thereof, perfluoro(C4-C 12)alkylsulfonic acid and a metal salt thereof, perfluorooctanesulfonic acid diethanol amide, N-propyl-N-(2-hydroxyethyl) perfluorooctanesulfonamide, a perfluoro(C6-C10)alkylsulfonamidepropyltrimethylammonium salt, a perfluoro(C6-C10)alkyl-N-ethylsulfonylglycine salt, monoperfluoro(C6-C16)alkylethylphosphate ester, and so forth.

Examples of the commercialized products thereof include SURFLON S-111, S-112, and S-113 (manufactured by Asahi Glass Co., Ltd.); FRORARD FC-93, FC-95, FC-98, and FC-129 (manufactured by Sumitomo 3M Ltd.); UNIDYNE DS-101 and DS-102 (manufactured by DAIKIN INDUSTRIES, Ltd.); MEGAFAC F-110, F-120, F-113, F-191, F-812, and F-833 (manufactured by DAINIPPON INK AND CHEMICALS, Inc.); FTOP EF-102, 103, 104, 105, 112, 123A, 123B, 306A, 501, 201, and 204 (manufactured by JEMCO Inc.); and FUTERGENT F-100 and F150 (manufactured by NEOS Co., Ltd.).

Furthermore, the cationic surfactants are not particularly limited, and may be appropriately selected depending on the intended purpose; examples thereof include aliphatic primary amine acid, aliphatic secondary amine acid or aliphatic tertiary amine acid which has a fluoroalkyl group; and an aliphatic quaternary ammonium salt such as perfluoro(C6-C10) alkylsulfonamidepropyltrimethyl ammonium salt, a benzalkonium salt, benzethonium chloride, and a pyridinium salt. Examples of name of the commercialized products thereof include SURFLON S-121 (manufactured by Asahi Glass Co., Ltd.), FRORARD FC-135 (manufactured by Sumitomo 3M Ltd.), UNIDYNE DS-202 (manufactured by DAIKIN INDUSTRIES, Ltd.); MEGAFAC F-150 and F-824 (manufactured by DAINIPPON INK AND CHEMICALS, Inc.); FTOP EF-132 (manufactured by JEMCO Inc.), and FUTERGENT F-300 (manufactured by NEOS Co., Ltd.).

Furthermore, for a dispersant that is an inorganic compound having poor solubility to water, tricalcium phosphate, calcium carbonate, titanium oxide, colloidal silica, and hydroxyapatite may be used.

Dispersed droplets in the dispersion may be stabilized by using a protective macromolecule colloid or fine organic particles insoluble in water. Examples thereof include acids such as acrylic acid, methacrylic acid, α-cyanoacrylic acid, α-cyanomethacrylic acid, itaconic acid, crotonic acid, fumaric acid, and maleic acid or maleic acid anhydride; (meth)acrylic series monomer containing a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycol monoacrylic acid ester, diethyleneglycol monomethacrylic acid ester, glycerin monoacrylic acid ester, glycerin monomethacrylic acid ester, N-methylolacrylamide, and N-methylolmethacrylamide; vinyl alcohols or ethers of vinyl alcohol, such as vinyl methyl ether, vinyl ethyl ether, and vinyl propyl ether; esters composed of vinyl alcohol and a compound having a carboxyl group, such as vinyl acetate, vinyl propionate, and vinyl butyrate; acrylamide, methacrylamide, and diacetoneacrylamide or a methylol compound of acrylamide, methacrylamide, and diacetoneacrylamide; acid chlorides such as acrylic acid chloride and methacrylic acid chloride; a homopolymer or a copolymer of a nitrogen-containing compound or a heterocyclic ring-containing compound, such as vinylpyridine, vinylpyrrolidone, vinylimidazole, and ethyleneimine; polyoxyethylene series such as polyoxyethylene, polyoxypropylene, polyoxyethylenealkylamine, polyoxypropylenealkylamine, polyoxyethylenealkylamide, polyoxypropylenealkylamide, polyoxyethylenenonyl phenyl ether, polyoxyethylenelauryl phenyl ether, polyoxyethylenestearyl phenyl ester, and polyoxyethylenenonyl phenyl ester; and celluloses such as methylcellulose, hydroxyethylcellulose, and hydroxypropylcellulose.

The dispersant is preferably a fine particle dispersant.

When a compound which is soluble in acid or alkali, such as calcium phosphate salt, is used as a dispersion stabilizer, the calcium phosphate salt can be removed from fine particles by dissolving the calcium phosphate salt with an acid such as hydrochloric acid and washing with water. Alternatively, the calcium phosphate salt can be removed by a decomposing procedure using an enzyme, etc. When a dispersant is used, the dispersant may be left on surfaces of toner particles, however, the dispersant is preferably cleaned and removed after the completion of the reaction for attaining a good electrostatic chargeability of the toner.

Furthermore, for lowering the viscosity of the toner composition, a solvent capable of dissolving the modified polyester resin which has been produced by reacting the polyester prepolymer can also be used for an organic solvent used in an oil phase. The solvent is preferably used from the view point of producing a particle size distribution having a small size of dispersion. The solvent is preferably volatile having a boiling point lower than 100° C. from the view point of readiness of removing the solvent. Examples of the solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These are used alone or in combination.

Among these, an aromatic solvent such as toluene and xylene; a halogenated hydrocarbon such as methylene chloride, 1,2-dichloroethane, chloroform, and carbon tetrachloride are particularly preferred. The amount of the solvent for use is usually 0 parts by mass to 300 parts by mass, preferably 0 parts by mass to 100 parts by mass, and more preferably 25 parts by mass to 70 parts by mass relative to 100 parts by mass of the polyester prepolymer. When the solvent is used, the solvent is removed by heating under a normal or reduced pressure, after the completion of propagation and/or cross-linking reaction.

The length of time for the propagation and/or cross-linking reaction is selected according to the reactivity determined by combination a polyester prepolymer and a compound having an active hydrogen group. The length of time for the propagation and/or cross-linking reaction is usually 10 minutes to 40 hours, and preferably 30 minutes to 24 hours. The reaction temperature is usually 0° C. to 100° C., and preferably 10° C. to 50° C. Furthermore, a known catalyst may be used as required, and specifically includes, for example, a tertiary amine such as triethyl amine and imidazole.

In order to remove the organic solvent from the emulsified dispersion thus obtained, a method of raising gradually the temperature of the entire reaction system to completely evaporate the organic solvent in liquid drops may be employed. A method including spraying the emulsified dispersion in a dried atmosphere, completely removing the water insoluble organic solvent in liquid drops to form fine toner particles, and simultaneously evaporating/removing the aqueous dispersant may be employed. For the dried atmosphere to which the emulsified dispersion is sprayed, gases produced by heating air, nitrogen gas, carbon dioxide gas, and a combustion gas, and especially various airflow heated at a temperature of a boiling point of the solvent having the highest boiling temperature among the solvents used or higher are generally used. The quality of gases aimed can be sufficiently obtained by a brief treatment using a spray drier, a belt drier, and a rotary kiln, etc.

When a particle size distribution at the time of emulsifying or dispersing is wide and a cleaning treatment and a drying treatment have been performed with the wide particle size distribution being maintained, the particle size distribution can be controlled by classifying the particles to a desired particle size distribution.

The classification can be performed by removing a fine particle portion in a liquid with a cyclone, a decanter or a centrifuge. The classification may be performed, of course, after obtaining the dried powder by the drying treatment, however, is preferably performed in a liquid from the view point of efficiency. The removed fine particles or coarse particles may be recycled to the particles at the kneading step again and used for the particle formation. When the removed fine particles or coarse particles are recycled, they may be wet.

The dispersant used is preferably removed from the dispersion thus obtained as much as possible, the removal of the dispersant is preferably performed at the same time as the above-mentioned classification.

It is possible to prevent the elimination of different type particles from surfaces of the composite particles thus obtained, by a method including fixing and melting on surfaces of the composite particles the resulting toner powder after drying and the different type particles such as fine releasing agent particles, fine charge controlling agent particles, fine fluidizer particles, and fine colorant particles by mixing the toner powder with the different type particles or applying a mechanical impact force to the powder mixture of the toner powder with the different type particles.

The specific method for applying the mechanical impact force includes a method of applying the impact force to the mixture using blades which rotate at high speed, and a method of placing the mixture in high speed gas flow and crashing the particles one another or the complex particles to an appropriate crash plate by accelerating. An apparatus used for such a method includes ANGMILL (manufactured by Hosokawa Micron Ltd.), an apparatus in which a pulverization air pressure has been reduced by remodeling I TYPE MILL (manufactured by Nippon Pneumatic MFG. Co., Ltd.), HYBRIDIZATION SYSTEM (Nara Machinery Co., Ltd.), CRYPTRON SYSTEM (manufactured by Kawasaki Heavy Industries, Ltd.), and an automatic mortar.

(External Additive)

The toner according to the present invention may contain an external additive for promoting flowability, develop ability, and chargeability.

For the external additives fine inorganic particles may be appropriately used. The primary particle diameters of the fine inorganic particles are preferably 5 nm to 2 μm, and more preferably 5 nm to 500 nm. The specific surface areas according to a BET method are preferably 20 $m^2/g$ to 500 $m^2/g$. The amount of the fine inorganic particles added is preferably 0.01% by mass to 5% by mass, and particularly preferably 0.01% by mass by to 2.0% by mass relative to the amount of the toner. Specific examples of the fine inorganic particles include silica, alumina, titanium oxide, barium titanate, magnesium titanate, calcium titanate, strontium titanate, zinc oxide, tin oxide, silica sand, clay, mica, wollastonite, diatom earth, chromium oxide, cerium oxide, colcothar, antimony trioxide, magnesium oxide, zirconium oxide, barium sulfate, barium carbonate, calcium carbonate, silicon carbide, and silicon nitride.

In addition to these fine inorganic particles, fine polymer particles can be used as the external additive. Examples of the fine polymer particles include polystyrenes obtained by soap-free emulsification polymerization, suspension polymerization, or dispersion polymerization; copolymers of a methacrylic acid ester and an acrylic acid ester; polycondensation products such as silicone, benzoguanamine, and nylon; and polymer particles derived from thermosetting resins.

The hydrophobicity of such flowability improver may be increased by a surface treatment, which can prevent degradation of flow characteristics or charging characteristics even at a high humidity. Examples such surface treating agent include a silane coupling agent, a silylating agent, a silane coupling agent having a fluorinated alkyl group, an organic titanate-based coupling agent, an aluminum-based coupling agent, a silicone oil, a modified silicone oil, and so forth.

The cleaning ability improver for removing a residual developer left, after transfer, on a photoconductor or a primary transfer medium, includes for example, a fatty acid metal salt such as zinc stearate, calcium stearate, stearic acid; and fine polymer particles produced by soap free emulsification polymerization such as fine polymethylmethacrylate particles and fine polystyrene particles. The fine polymer particles preferably have relatively narrow particle size distribution and appropriately have a volume average particle diameter of 0.01 μm to 1 μm.

In the present invention, acid values were determined in accordance with a method of JIS K0070-1992 as follows.

Specifically, a 0.5-g sample (equivalent to a 0.3 g of a fraction soluble in ethyl acetate) was added to 120 mL toluene and dissolved by stirring for about 10 hours at room temperature (23° C.). Further 30 mL of ethanol was added to prepare a sample solution. Note that when the sample does not dissolve a solvent such as dioxane, and tetrahydrofuran may be used. The acid value is determined at 23° C. by means of an electrical potential difference type automatic titration device (DL-53 TITRATOR, manufactured by Mettler Toledo International Inc.) with an electrode (DG113-SC, manufactured by Mettler-Toledo International Inc.), and the acid value thus determined is analyzed using an analysis software LabX Light Version 1.00.000.

For calibrating the device, a solvent mixture of 120 mL toluene and 30 mL ethanol is used.

The conditions for measurement of an acid value are the same as those for measurement of a hydroxyl group value.

Thus, an acid value can be determined as mentioned above. Specifically, the sample solution was titrated with an alcohol solution containing 0.1 N potassium hydroxide previously standardized. Then, based on the titres of the alcohol solution containing potassium hydroxide, the acid value is calculated using the following equation:

Acid value [KOHmg/g]=Titre of solution (mL)×N×56.1 [mg/mL]/sample weight [g] (where N is a factor of the alcohol solution containing 0.1 N potassium hydroxide).

The crystalline polyester resin in the present invention preferably has a glass transition temperature of 40° C. to 70° C. When the glass transition temperature is lower than 40° C., the heat-resistant storage stability may be degraded. When the glass transition temperature is higher than 70° C., the low-temperature fixing ability may be degraded.

A glass transition temperature is determined, in the present invention, using Rigaku THERMOFLEX TG8110 (manufactured by Rigaku Industrial Corp) and 10TG-DSC system TAS-100 (manufactured by Rigaku Industrial Corp).

Specifically, an about 10-mg sample is placed in an aluminum sample container, and the aluminum sample container is put on a holder unit, which is then set in an electrical furnace. The temperature of the sample container is increased from a room temperature to 150° C. with a temperature increase rate of 10° C./min. Subsequently, the sample container is left for 10 minutes at 150° C., the sample is cooled to room temperature, the cooled sample is left for 10 minutes, and heated again to 150° C. with a temperature increase rate of 10° C./min. in a nitrogen atmosphere for measurement by DSC.

The glass transition temperature is determined by calculating a temperature of an intersection point of a tangent line of endothermic curve near the glass transition temperature and the base line of the endothermic curve using an analysis system contained in TAS-100 system.

(One-Component Developer and Two-Component Developer)

When the toner according to the present invention is used in a two-component developer, the toner may be mixed with a magnetic carrier for use. The amount of the toner in the developer is preferably 1 part by mass to 10 parts by mass relative to 100 parts by mass of the carrier. Examples of the magnetic carrier include those known previously such as an iron powder having particle diameters of about 20 μm to 200 μm, a ferrite powder, a magnetite powder, and a magnetic resin carrier. Examples of coating materials include amino resins such as urea-formaldehyde resins, melamine resins, benzoguanamine resins, urea resins, and polyamide resins.

In addition to the above examples, for the coating materials, polyvinyl resins and polyvinylidene resins such as acrylic resins, polymethylmethacrylate resins, polyacylonitrile resins, polyvinyl acetate resins, polyvinyl alcohol resins, and polyvinyl butyral resins; polystyrene resins such as polystyrene resin and styrene-acrylic copolymer resins; halogenated olefin resins such as polyvinyl chloride resins; polyester resins such as polyethylene terephthalate resins, and polybutylene terephthalate resins; polycarbonate resins; polyethylene resins; polyvinyl fluoride resins; polyvinlylidene fluroride resins; polytrifluoroethylene resins; polyhexafluoropropylene resins; copolymers of vinylidene fluoride and an acrylic monomer, copolymers of vinylidene fluoride and vinyl fluoride, fluoroterpolymers such as terpolymers of tetrafluoroethylene, vinylidene fluoride, and a non-fluoro monomer; silicone resins; and epoxy resins may be used.

The coating resin may contain conductive powder or the like as required; examples of the conductive powder include metal powder, carbon black, titanium oxide, tin oxide, and zinc oxide. These conductive powders preferably have an average particle diameter of 1 μm or less. When the average particle diameter is larger than 1 μm, it may be difficult to control the electrical resistance.

Furthermore, the toner according to the present invention may be used as a one-component magnetic toner which contains no carrier or as a non-magnetic toner.

In the present invention, a particle size distribution is determined by a Coulter Counter method.

The particle size distribution is determined with a measurement device such as Coulter Counter TA-II and Coulter Multsizer II (both are manufactured by Coulter Company Limited).

In the present invention, a particle size distribution is measured with a measurement system in which a Coulter Counter TA-II measurement device is connected to a personal computer (PC-9801, manufactured by NEC Corporation) via an interface (manufactured by the Institute of JUSE) which can be used for outputting a number distribution and a volume distribution.

Specifically, first, 0.1 mL to 5 mL of a surfactant (preferably, alkylbenzene sulfonate) is added to 100 mL to 150 mL of an electrolyte solution for a dispersant. Note that the electrolyte liquid, herein, is an about 1% by mass sodium chloride aqueous solution prepared with a first grade sodium chloride, for an available example, is ISOTON-II (manufactured by Coulter Company Limited). After the sample for measurement (2 mg to 20 mg) has been added, the electrolyte liquid in which the sample is suspended is subjected to a dispersion treatment for 1 minute to 3 minutes by an ultrasonic dispersion device. The volume and the number of the toner particles are determined by subjecting the thus prepared dispersion to the measurement device using a 100 μm aperture as an aperture to calculate volume distribution and number distribution.

As channels, 13 channels are used, that is, channels of sizes of 2.00 μm or larger but smaller than 2.52 μm; 2.52 μm or larger but smaller than 3.17 μm; 3.17 μm or larger but smaller than 4.00 μm; 4.00 μm or larger but smaller than 5.04 μm; 5.04 μm or larger but smaller than 6.35 μm; 6.35 μm or larger but smaller than 8.00 μm; 8.00 μm or larger but smaller than 10.08 μm; 10.08 μm or larger but smaller than 12.70 μm; 12.70 μm or larger but smaller than 16.00 μm; 16.00 μm or larger but smaller than 20.20 μm; 20.20 μm or larger but smaller than 25.40 μm; 25.40 μm or larger but smaller than 32.00 μm; 32.00 μm or larger but smaller than 40.30 μm; and thus particles having the diameter in the range of 2.00 μm or larger but smaller than 40.30 μm are covered for the measurement.

The toner of the present invention preferably has a volume average particle diameter (Dv) of 3 μm to 7 μm, and a ratio Dv/Dn of 1.2 or less where Dn is a number average particle diameter of the toner. In addition, the toner of the present invention preferably contains a component having a particle diameter of 2 μm or less in an amount of 1% by number to 10% by number.

The acid value of the toner of the present invention is an important indicator of low-temperature fixing ability and anti-hot offset property, and varies according to the existence of a terminal carboxylic acid group of the unmodified polyester resin. In order to control the low-temperature fixing ability (lower limit temperature for fixing, and hot-offset occurring temperature), the acid value of the toner of the present invention is preferably 0.5 KOHmg/g to 40 KOHmg/g.

When the acid value is higher than 40 KOHmg/g, the anti-hot offset property may be degraded, because the reactive modified polyester resin may not be sufficiently propagated and/or cross-linked. Furthermore, when the acid value is lower than 0.5 KOHmg/g, the production stability may be degraded, because the toner fails to provide an effect for improving the dispersion stability, which is caused by a base when the toner is produced, and because the propagation and the crosslinking of the reactive modified polyester resin are promoted.

The toner of the present invention preferably has a glass transition temperature of 40° C. to 70° C., which makes it possible to achieve excellent low-temperature fixing ability, excellent heat resistant storage stability, and high durability.

When the glass transition temperature is lower than 40° C., blocking in a developing device or filming on a photoconductor may occur. When the glass transition temperature is higher than 70° C., the low-temperature fixing ability may be degraded.

In an image forming method and an image forming apparatus of the present invention, the toner of the present invention which achieves a stable low-temperature fixing ability and anti-hot offset property is employed, which makes it possible to efficiently produce high quality images.

<Image Forming Method and Image Forming Apparatus>

The image forming method according to the present invention includes at least a charging step in which the surface of the latent electrostatic image bearing member is charged, an exposing step in which the thus charged latent electrostatic image bearing member is exposed to light to form a latent electrostatic image, a developing step in which the latent electrostatic image is developed with a toner to form a visible image, a transferring step in which the visible image is transferred onto a recording medium to form a transfer image, and a fixing step in which thus transferred transfer image on the recording medium is fixed, wherein the toner of the present invention is used for a toner.

The image forming apparatus according to the present invention is equipped with at least a latent image bearing member (a photoconductor), a charging unit configured to charge the surface of the latent electrostatic image bearing member, an exposing unit configured to expose thus charged surface of the latent electrostatic image bearing member to form a latent electrostatic image, a developing unit configured to develop the latent electrostatic image with a toner to form a visible image, a transferring unit configured to transfer the visible image onto a recording medium to form a transfer image, and a fixing unit configured to fix the transfer image which has been transferred onto the recording medium, as well as further a cleaning unit configured to clean the latent image bearing member after the visible image has been transferred, wherein the image forming apparatus contains the toner of the present invention for a toner.

(Image Forming Apparatus)

An image forming apparatus in which the toner of the present invention is used is outlined below.

The image forming apparatus according to the present invention is equipped with at least a latent electrostatic image bearing member (a photoconductor), a charging unit configured to charge the surface of the latent electrostatic image bearing member, an exposing unit configured to expose thus charged surface of the latent electrostatic image bearing member to form a latent electrostatic image, a developing unit configured to develop the latent electrostatic image with a toner to form a visible image, a transferring unit configured to transfer the visible image onto a recording medium to form a transfer image, and a fixing unit configured to fix the transfer image which has been transferred onto the recording medium, wherein the image forming apparatus contains the toner of the present invention for a toner.

For an example of an electrophotographic image forming apparatus of the present invention, a copier is shown in FIG. 1.

An example of a view of the internal structure of a color image forming apparatus according to an embodiment of the present invention is shown in FIG. 1. This specific example is a tandem type indirect transfer electrophotographic copier, however, the image forming apparatus of the present invention should not be construed as limiting to this specific example.

In FIG. 1, 100 indicates the main body of a copier, 200 indicates a paper feeder table on which the main body of the copier 100 is mounted, 300 indicates a scanner (an optical reader) mounted on the main body of the copier 100, and 400 indicates an automated document feeder (ADF) mounted further on the scanner. At the central part in the main body of the copier 100, an intermediate transfer member 10, which has an endless belt shape and which extends horizontally, is placed. In FIG. 1, the intermediate transfer member 10 is stretched by three supporting rollers 14, 15 and 16, and is capable of rotating clockwise and conveying the paper in FIG. 1. To the left of a second supporting roller 15, among the three supporting rollers, a cleaning device 17 for intermediate transfer member for removing the residual toners remained on the intermediate transfer member 10 after the image transfer is placed. Above the intermediate transfer member 10 stretched by two of the three supporting rollers, that is by the first supporting roller 14 and the second supporting roller 15, a tandem-type image forming part 20, in which 4 image forming units 18 of black, yellow, magenta, and cyan are placed in parallel in the direction of conveying direction of the intermediate transfer member. Directly above the tandem-type developing parts 20, an exposing device 21 is placed as is shown in FIG. 1. On the other hand, a secondary transfer device 22 is placed at the side, with respect to the intermediate transfer member 10, counter to the side of the tandem-type image forming part 20. As is shown in FIG. 1, in the secondary transfer device 22, a secondary transfer belt 24, which is an endless belt and stretched by a pair of rollers 23, is placed so as to be pressed against the third supporting roller 16 via the intermediate transfer member 10, and an image on the intermediate transfer member 10 is transferred onto a sheet. By the vicinity of the secondary transfer device 22, a fixing device 25 configured to fix the transfer image on the sheet is placed. The fixing device 25 is composed of a fixing belt 26 of an endless belt shape and a pressure roller 27 for applying pressure on the fixing belt. The above mentioned secondary transfer device 22 has a functional unit configured to convey sheets, onto which an image has been transferred, to the fixing device 25. In the above-mentioned tandem image forming apparatus 20, under the secondary transfer device 22 and the fixing device 25, a sheet reverser 28 for reversing a sheet to record images on the both sides of the sheet is placed in parallel When an image is copied using this color electrophotographic apparatus, first a document is set on the document platen 30 of the automated document feeder (ADF) 400, or alternatively the automated document feeder 400 is opened, the document is set on a contact glass 32 of the scanner 300 and the automated document feeder 400 is closed. By turning on a start switch (not shown), a first carriage 33 and a second carriage 34 start to be shifted by the scanner 300 which is driven, with a lapse of time from the time of turning on the start switch during which the document has been conveyed to and arrived at contact glass 32 when the document has been set in the automated document feeder 400, or immediately after the time of turning on the start switch in case of the document having been set on the contact glass 32. At this time, light is emitted from a light source of the first carriage 33 to the document, and the reflected light from the document is further reflected toward the second carriage 34. The reflected light is further reflected by a mirror of the second carriage 34 and passes through an image-forming lens 35 into a read sensor 36 to thereby read the document. When a start switch (not shown) is turned on, one roller of the supporting rollers 14, 15, and 16 is driven to rotate directly by force of a driving motor (not shown) and the other two rollers are rotated according to the rotation of the intermediate transfer member which is produced by the rotation of the former roller, thereby the intermediate transfer member 10 is rotated and fed. At the same time as each photoconductor 40 is rotated with each image forming unit 18 to form monochrome images of black, yellow, magenta, and cyan on respective photoconductor 40.

Then each monochrome image of black, yellow, magenta, and cyan is sequentially transferred onto an intermediate transfer body 10, which is being fed, to form a superimposed color image thereon. On the other hand, when a start switch (not shown) is turned on, one of feeder rollers 42 in the paper feeder table 200 is selected and rotated, and sheets are ejected from one of the multiple feeder cassettes 44, which are coupled in a paper bank 43, and the sheets are separated sheet by sheet with a separation roller 45 to feed the sheets into a paper feeder path 46, the sheets thus fed are conveyed with a conveying roller 47 to be fed into a paper feeder path 48 in the main body of the copier 100, and the sheet being conveyed into the paper feeder path 48 is stopped with a registration roller 49, to which the sheet is bumped. Subsequently, the registration roller 49 is rotated so timed that the superimposed color image formed on the intermediate transfer member 10 is transferred and recorded, with a secondary transfer member 22, onto a sheet which has been sent to a slit between the intermediate transfer member 10 and the secondary transfer member 22 with the registration roller 49. The sheet on which the image has been transferred is, then, sent to a fixing device 25 using a secondary transfer member 22, the transferred image is fixed by applying heat and pressure thereto using the fixing device 25, the conveyance direction of the sheet is switched via a switch click 55, and the sheet is ejected using an ejection roller 56 to be stacked on an ejection tray 57. Alternatively, the sheet on which the image has been transferred is fed into the sheet reverser 28 by switching the sheet conveyance direction via the switch click 55, and the sheet is turned over and returned to the transfer position for recording an image on the reverse side thereof, then the sheet is ejected on the ejection tray 57 using the ejection roller 56. Meanwhile, residual toner remained on the intermediate transfer member 10 after the transfer of the image is removed using a cleaning device 17 of the intermediate transfer member so that the intermediate transfer member 10 after the transfer of the image can be used for next image formation cycle carried out using the tandem image formation part 20.

In the above-mentioned tandem image formation part 20, each image formation unit 18 is equipped with a charging unit, a developing unit, a primary transfer unit 62, and a charge elimination unit around the drum of the photoconductor 40.

Figure 2:
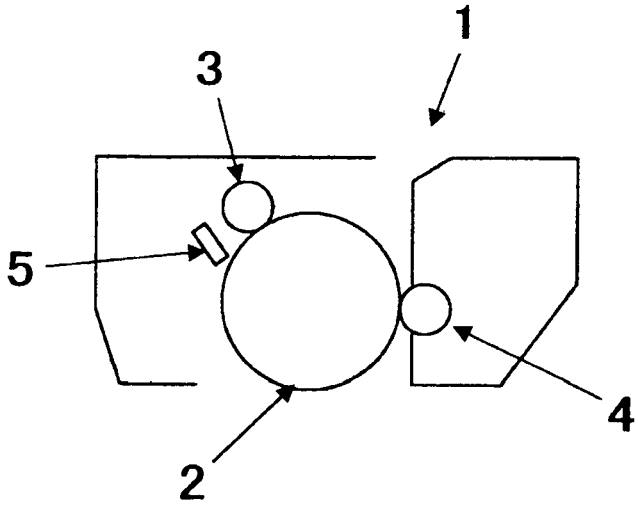
FIG. 2 is a view showing an example of a process cartridge.

FIG. 2 shows a schematic view of the structure of a process cartridge in which the toner of the present invention is used. In FIG. 2, index numbers 1, 2, 3, 4, and 5 represent the whole process cartridge, a photoconductor, a charging unit, a developing unit, and a cleaning unit, respectively.

In the present invention, a plurality of elements selected from the above-mentioned elements, that is, the photoconductor 2, the charging unit 3, the developing unit 4, and the cleaning unit 5, is combined to form the process cartridge, which is then detachably mounted on the main body of an image forming apparatus such as copiers and printers.

In an image forming apparatus having the process cartridge containing the toner of the present invention, the photoconductor is driven to rotate at a predetermined peripheral speed. While the photoconductor is rotated, the photoconductor is charged with the charging unit so as to have a uniform, positive or negative electric potential having a predetermined size thereon, and then exposed to an image exposure light from an image exposure unit such as a slit exposure light or a scanning laser beam exposure light. Thus, latent electrostatic images are sequentially formed around the photoconductor, the latent electrostatic images thus formed are developed with a toner using the developing unit to form toner images, the toner images thus developed are sequentially transferred, with a transfer unit, onto a transfer medium which is sent from the paper sending part to the slit between the photoconductor and the transfer unit, being synchronized with the rotation of the photoconductor. The transfer medium on which the toner images have been transferred is separated from the surface of the photoconductor to be introduced into a fixing unit and the images thereon are fixed. Then the transfer medium on which an image has been fixed is printed out from the image forming apparatus as a transcript (a copy). The surface of the photoconductor after the transfer of the image is cleaned, with a cleaning unit having at least a cleaning blade, to remove residual toner remained thereon after the transfer of the image, and the surface of the photoconductor is made ready for the next image formation cycle by further eliminating the residual electricity remained thereon.

EXAMPLES

Hereinafter, the present invention will be further described referring to the following Examples, however, the present invention should not be construed as limiting to these Examples. In the following description, 'part(s)' means 'part(s) by mass'.

Production Example 1

—Synthesis of Crystalline Polyester Resin—

Into a 5-L four-necked flask equipped with a nitrogen inlet tube, a dewatering conduit, a stirring device, and a thermocouple, 2,070 g of 1,4-butanediol, 2,535 g of fumaric acid, 291 g of trimellitic anhydride, and 4.9 g of hydroquinone were added, and then the mixture was allowed to react at 160° C. for 5 hour. Subsequently the temperature of the mixture was increased to 200° C. and the mixture was reacted at 200° C. for 1 hour, and then further reacted under a pressure of 8.3 kPa for 1 hour to prepare [crystalline polyester resin 1]. The [crystalline polyester resin 1] had an endothermic peak temperature, as quantified by DSC, of 123° C., Mn of 900, and Mw of 3,500.

Production Example 2

[Crystalline polyester resin 2] was synthesized in the same manner as in the Production Example 1, except that type and quantity of the alcohol component and the acid component were changed. The properties of the [Crystalline polyester resin 2] are shown in the following Table 1.

TABLE 1

| Crystalline polyester resin | DSC endothermic peak temperature (° C.) | Mw | Mn |
|---|---|---|---|
| No. 1 | 123 | 3,500 | 900 |
| No. 2 | 95 | 11,000 | 2,000 |

Example 1

Production Example 1

—Synthesis of Amorphous Polyester (Low-Molecular Weight Polyester) Resin—

Into a reaction container equipped with a cooling tube, a stirrer, and a nitrogen inlet tube, 229 parts of ethyleneoxide (2 moles) adduct of bisphenol A, 529 parts of propyleneoxide (3 moles) adduct of bisphenol A, 208 parts of terephthalic acid, 46 parts of adipic acid, and 2 parts of dibutyltin oxide were added, and the mixture was allowed to react at 230° C. under a normal pressure for 8 hours, then allowed to further react under a reduced pressure of 10 mmHg to 15 mmHg for 5 hours. Subsequently, into the reaction container 44 parts of trimellitic anhydride were added, and the resultant mixture was allowed to react at 180° C. under a normal pressure for 2 hours to prepare [Low-molecular weight polyester 1]. The [Low-molecular weight polyester 1] had Mn of 2,500, Mw of 6,700, Tg of 43° C., and an acid value of 25.

Production Example 2

—Synthesis of Polyester Prepolymer—

Into a reaction container equipped with a cooling tube, a stirrer, and a nitrogen inlet tube, 682 parts of ethyleneoxide (2 moles) adduct of bisphenol A, 81 parts of propyleneoxide (2 moles) adduct of bisphenol A, 283 parts of terephthalic acid, 22 parts of trimellitic anhydride, and 2 parts of dibutyltin oxide were added, and the mixture was allowed to react at 230° C. under a normal pressure for 8 hours, then allowed to further react under a reduced pressure of 10 mmHg to 15 mmHg for 5 hours to prepare [Intermediate body polyester 1]. The [Intermediate body polyester 1] had Mn of 2,100, Mw of 9,500, Tg of 55° C., and an acid value of 0.5, and a hydroxyl value of 51.

Next, into a reaction container equipped with a cooling tube, a stirrer, and a nitrogen inlet tube, 410 parts of [Intermediate body polyester 1], 89 parts of isophorone diisocyanate, and 500 parts of ethyl acetate were added, and the mixture was allowed to react at 100° C. for 5 hours to prepare [Prepolymer 1]. The amount of free isocyanate molecules in the [Prepolymer 1] was 1.53% by mass.

Production Example 3

—Synthesis of Ketimine—

Into a reaction container in which a stirrer and a thermometer were set, 170 parts of isophorone diamine and 75 parts of methyl ethyl ketone were added, and the mixture was allowed to react at 50° C. for 5 hours to prepare [Ketimine compound 1]. The [Ketimine compound 1] had an amine value of 418.

Production Example 4

—Synthesis of Master Batch (MB)—

One thousand and two hundred parts of water, 540 parts of carbon black (Printex 35, manufactured by Evonik Degussa Japan Co. Ltd.; DBP Oil absorption amount=42 mL/100 mg, pH 9.5), and 1,200 parts of the [Crystalline polyester resin 1] were added and mixed in a Henschell mixer (manufactured by Mitsui Mining & Smelting Co., Ltd.), and the resultant mixture was kneaded with a two roll mill at 150° C. for 30 min, then the resultant kneaded product was cooled by extending the product under pressure, and pulverized with a pulverizer to prepare [Master batch 1].

Production Example 5

—Preparation of Oil Phase—

Into a container in which a stirrer and a thermometer were set, 378 parts of [Low-molecular weight polyester 1], 110 parts of carnauba wax, 22 parts of CCA (salicylic acid-based metal complex E-84, manufactured by Orient Chemical Industries Co., Ltd.), and 947 parts of ethyl acetate were added. Subsequently, the temperature of the mixture was increased to 80° C. while stirring, and the mixture was left at 80° C. for 5 hours, and then the temperature of the mixture was decreased to 30° C. in 1 hour. Then, 500 parts of [Master batch 1] and 500 parts of ethyl acetate were placed in the container, and mixed for 1 hour to prepare [Raw material solution 1].

One thousand and three hundred twenty four parts of [Raw material solution 1] was transferred to a container, and the carbon black and the wax were dispersed by means of a bead mill (Ultraviscomill, manufactured by Aimex Co., Ltd.)under the following conditions: solution sending speed: 1 kg/hr, disk peripheral velocity: 6 m/sec; filling: 80% by volume of the container with 0.5 mm zirconium beads; and times of pass: 3. Next, 1042.3 parts of ethyl acetate solution containing 65% [Low-molecular weight polyester 1] was added to the resultant dispersion and the resultant mix was subjected to the above-mentioned dispersion treatment using the bead mill under the same conditions as above for one pass to prepare [Pigment/wax dispersion 1]. The [Pigment/wax dispersion 1] had a solid content (at 130° C., for 30 min.) of 50%.

Production Example 6

—Preparation of Crystalline Polyester Dispersion—

Into a 2-L metal container, 100 g of [crystalline polyester resin No.1], 100 g of [Low molecular weight polyester 1], and 400 g of ethyl acetate were added, and the mixture was heated and dissolved at 77° C., then rapidly cooled in an ice water bath with a temperature decrease rate of 27° C./min. Into this metal container, 500 mL of glass beads (diameter: 3 mm) were added, and the contents of the metal container were pulverized for 12 hours with a batch type sand mill device (manufactured by Kanpe Hapio Co., Ltd.) to prepare [crystalline polyester dispersion 1] which has a volume average particle diameter of 0.3 μm.

Production Example 7

—Synthesis of Emulsion of Fine Organic Particles—

Into a reaction container in which a stirrer and a thermometer were set, 683 parts of water, 11 parts of a sodium salt of a sulfate of an ethylene oxide adduct of methacrylic acid (Eleminor RS-30, manufactured by Sanyo Chemical Industries, Ltd), 138 parts of styrene, 138 parts of methacrylic acid, and 1 part of ammonium persulfate were added, and the resultant mixture was stirred for 15 minutes at a revolution frequency of 400 rpm to obtain a white milky emulsion. The white milky emulsion was heated to a temperature of a system of 75° C., and allowed to react for 5 hours. Subsequently, further 30 parts of a 1% ammonium persulfate aqueous solution were added, and the resultant mixture was matured at 75° C. for 5 hours to prepare [Fine particle dispersion 1] which was an aqueous dispersion of vinyl resin (Styrene-methacrylic acid—a sodium salt of a sulfate of an ethyleneoxide adduct of methacrylic acid copolymers). [Fine particle dispersion 1] had a volume average particle diameter of 0.14 μm as quantified with LA-920. A portion of [Fine particle dispersion 1] was dried to separate its resin component.

Production Example 8

—Preparation of Water Phase—

Nine hundred ninety parts of water, 83 parts of [Fine particle dispersion 1], 37 parts of an aqueous solution containing 48.5% sodium dodecyl diphenyl ether disulfonate (Eleminor MON-7, manufactured by Sanyo Chemical Industries, Ltd.), and 90 parts of ethyl acetate were mixed and stirred to prepare [Water phase 1] which was a milky white liquid.

Production Example 9

—Emulsifying/Desolventizing Agent—

Six hundred sixty four parts of [Pigment/wax dispersion 1], 109.4 parts of [Prepolymer 1], 73.9 parts of [Crystalline polyester dispersion 1], and 4.6 parts of [Ketimine compound 1] were placed in a container, and mixed with T.K. Homo Mixer (manufactured by PRIMIX Corporation) at 5,000 rpm for 1 minute, and 1,200 parts of [Water phase 1] was added to the container, then the mixture was mixed with the TK Homo Mixer at a revolution frequency of 13,000 rpm for 20 minutes to prepare [Emulsion slurry 1].

[Emulsion slurry 1] was placed into a container in which a stirrer and a thermometer were set, and the container was desolventized at 30° C. for 8 hours, then matured at 45° C. for 4 hours to obtain [Dispersion slurry 1].

—Cleaning and Drying—

One hundred parts of the resultant [Dispersion slurry 1] was filtered under reduced pressure, and the resultant filter cake was cleaned and dried as follows:

(1) One hundred parts of ion exchange water were added to the filter cake, and the resultant slurry was mixed using TK HOMO MIXER (for 10 minutes at a revolution frequency of 12,000 rpm) and then filtrated.
(2) One hundred parts of 10% sodium hydroxide were added to the filter cake prepared in (1), and the resultant slurry was mixed (for 30 minutes at a revolution frequency of 12,000 rpm) with TK HOMO MIXER, then filtered under reduced pressure.
(3) One hundred parts of 10% hydrochloric acid was added to the filter cake prepared in (2), and the resultant slurry was mixed with TK HOMO MIXER (at a revolution frequency of 12,000 rpm for 10 minutes), then the mix was filtered.
(4) Three hundred parts of ion exchange water were added to the filter cake prepared in (3), and the resultant slurry was mixed using TK HOMO MIXER (for 10 minutes at a revolution frequency of 12,000 rpm), then the resultant mix was filtered. These operations were performed twice to prepare [Filter cake 1].

The resultant [Filter cake 1] was dried at 45° C. for 48 hours using an air circulation dryer, and the dried [Filter cake 1] was sieved through a mesh with an opening having a size of 75 μm to prepare [Toner 1].

Examples 2 to 4, Comparative Examples 1 and 2

[Crystalline polyester dispersions 2 to 6] were prepared in the same manner as in Example 1, except that their conditions for dispersion were changed to those specified in the following Table 2.

[Toners 2 to 6] were prepared in the same manner as in Example 1, except that the toners were produced with dispersions of crystalline polyester as specified in Table 3.

TABLE 2

| Dispersion of crystalline polyester | Crystalline polyester | Amorphous polyester in dispersing step | Duration of dispersion (hr) | Dispersion particle diameter (μm) |
|---|---|---|---|---|
| No. 1 | No. 1 | present | 12 | 0.3 |
| No. 2 | No. 1 | present | 6 | 0.9 |
| No. 3 | No. 1 | absent | 12 | 1.3 |
| No. 4 | No. 2 | present | 12 | 0.2 |
| No. 5 | No. 2 | present | 6 | 0.8 |
| No. 6 | No. 2 | absent | 12 | 1.2 |

Comparative Example 3

[Toner 7] was prepared in the same manner as in Example 1, except that dispersion of crystalline polyester was not used.

Hydrophobic silica (0.7 parts) and 0.3 parts of hydrophobized titanium oxide were added to 100 parts of the toner thus prepared, and the resultant mixture was mixed with a Henschel mixer. The results of evaluation of each toner thus prepared are shown in Table 3.

A developer containing 5% by mass of the toner, which had been treated to bear external additives, and 95% by mass of a copper-zinc ferrite carrier, which had an average particle diameter of 40 μm and was covered with a silicone resin, was prepared. An image was continuously printed on sheets of paper by means of a copier (IMAGIO NEO 450, manufactured by Ricoh Company, Ltd.) which was capable of printing on 45 sheets of A4 size paper per minute, using the developer. Then, the following properties were evaluated according to the following criteria.

(Items for Evaluation)

(Particle Size)

A particle diameter of each toner was measured by means of a particle size measuring instrument (Coulter Counter TA II, manufactured by Coulter Electronics Ltd.), using an aperture having a diameter of 100 μm. A volume average particle diameter and a number average particle diameter were determined using the above particle size measuring instrument.

(Fixability)

A test for copying was carried out on type 6200 paper (Ricoh Company Ltd.) using a copier which had been arranged by modifying a fixing part of a copier (MF2200, manufactured by Ricoh Company Ltd.) so as to have a TEFLON roller for a fixing roller.

Specifically, a temperature at which cold offset would occur (lower limit temperature for fixing) and a temperature at which hot offset would occur (upper limit temperature for fixing) were determined by changing temperatures for fixation.

Conditions for evaluation of the lower limit temperature for fixation were as follows: linear speed for paper sending: 120 mm/sec to 150 mm/sec; pressure applied on surface: 1.2 kgf/cm$^2$; and a nip width: 3 mm.

Conditions for evaluation of the upper limit temperature for fixation were as follows: linear speed for paper sending: 50 mm/sec; pressure applied on surface: 2.0 kgf/cm$^2$; and a nip width: 4.5 mm.

Note that the lower limit temperature for fixation of a conventional low-temperature fixing toner is about 140° C.

Evaluation criteria for lower limit temperature for fixation are as follows:

A: lower limit temperature for fixation was lower than 120° C.

B: lower limit temperature for fixation was 120° C. or higher, but lower than 130° C.

C: lower limit temperature for fixation was 130° C. or higher, but lower than 140° C.

D: lower limit temperature for fixation was 140° C. or higher, but lower than 150° C.

(Heat Resistant Storage Stability)

Each toner was stored at 50° C. for 8 hours, and sieved through a 42-mesh sieve for 2 minutes. Then, a proportion of the toner remained on a gold wirework was determined.

In this case, the better the heat-resistant storage stability of the toner is, the smaller the proportion of the toner remained on the gold wirework.

The evaluation criteria for the heat-resistant storage stability are as follows:

A: proportion of the toner remained on a sieve was less than 20%

B: proportion of the toner remained on a sieve was 20% or more

TABLE 3

| | Toner | Dispersion of crystalline polyester used | Dispersion diameter (μm) | Particle size distribution Dv/Dn | Low-temperature fixing ability | Heat resistant storage stability | Total evaluation |
|---|---|---|---|---|---|---|---|
| Ex. 1 | Toner 1 | No. 1 | 0.3 | 1.15 | B | A | A |
| Ex. 2 | Toner 2 | No. 2 | 0.9 | 1.19 | B | A | A |
| Ex. 3 | Toner 3 | No. 4 | 0.2 | 1.14 | A | A | A |
| Ex. 4 | Toner 4 | No. 5 | 0.8 | 1.17 | B | A | A |
| Comp. Ex. 1 | Toner 5 | No. 3 | 1.3 | 1.27 | C | B | B |
| Comp. Ex. 2 | Toner 6 | No. 6 | 1.2 | 1.24 | B | B | B |
| Comp. Ex. 3 | Toner 7 | — | — | 1.14 | D | A | B |

What is claimed is:

1. A method for producing a toner, comprising:

dispersing, in an aqueous medium, an oil phase which contains an organic solvent, and a binder resin component contained in the organic solvent, where the binder resin component contains a crystalline polyester resin and an amorphous polyester resin; and removing the organic solvent from the dispersion to obtain the toner, wherein the dispersing further contains heating and dissolving the crystalline polyester and the amorphous polyester in the organic solvent to obtain a solution, cooling the solution so as to recrystallize the crystalline polyester resin, and mechanically pulverizing the recrystallized crystalline polyester resin so as to obtain a crystalline polyester dispersion.

2. The method for producing a toner according to claim 1, wherein the crystalline polyester resin contained in the dispersion of the crystalline polyester has a volume average particle diameter of 0.1 μm to 1.0 μm.

3. The method for producing a toner according to claim 1, wherein the crystalline polyester resin has an endothermic peak temperature of 50° C. to 130° C. in a DSC curve thereof.

4. The method for producing a toner according to claim 1, wherein the crystalline polyester resin has an endothermic peak temperature of 85° C. to 130° C. in a DSC curve thereof.

5. The method for producing a toner according to claim 1, wherein the binder resin component of the oil phase further contains a precursor of a binder resin.

6. The method for producing a toner according to claim 1, wherein the dispersing is: dissolving or dispersing at least a colorant, a releasing agent, the crystalline polyester dispersion, a precursor of a binder resin containing a modified polyester resin, and the binder resin component other than foregoing in the organic solvent to obtain the oil phase; dissolving a compound capable of extending or crosslinking the precursor in the oil phase; dispersing the oil phase in the aqueous medium in which a fine particle dispersing agent is present so as to obtain an emulsified dispersion; allowing the precursor to carry out a crosslinking reaction, or an extension reaction, or both thereof in the emulsified dispersion, and wherein the removing is removing the organic solvent from the emulsified dispersion.

7. The method for producing a toner according to claim 1, wherein a fraction of the crystalline polyester resin soluble in o-dichlorobenzene shows a molecular weight distribution, as quantified by GPC, having a weight average molecular weight (Mw) of 1,000 to 30,000, a number average molecular weight (Mn) of 500 to 6,000, and a ratio Mw/Mn of 2 to 10.

8. The method for producing a toner according to claim 1, wherein the crystalline polyester resin has a structure represented by the following general formula (1):

$$[—O—CO—(CR^1{=}CR^2)_l—CO—O—(CH_2)_n—]_m \qquad \text{General Formula (1)}$$

where n and m each represent the number of respective repeating units, 1 represents an integer from 1 to 3, $R^1$ and $R^2$ each represent a hydrogen atom or a hydrocarbon group and may be identical to or different from each other.

9. The method for producing a toner according to claim 1, wherein the crystalline polyester resin contains an alcohol component and an acid component, where the alcohol component contains a C2-C6 diol compound, and the acid component contains at least one selected from the group consisting of fumaric acid and a derivative thereof.

10. The method for producing a toner according to claim 1, wherein the crystalline polyester resin contains an alcohol component, where the alcohol component contains at least one selected from the group consisting of 1,4-butanediol, 1,6-hexanediol, and a derivative thereof.

11. The method for producing a toner according to claim 1, wherein the toner has a volume average particle diameter of 3 μm to 7 μm.

12. The method for producing a toner according to claim 1, wherein the toner satisfies a ratio Dv/Dn of 1.2 or less, where Dv is a volume average particle diameter of the toner, and Dn is a number average particle diameter of the toner.

* * * * *